US008463115B1

(12) United States Patent
Groves et al.

(10) Patent No.: US 8,463,115 B1
(45) Date of Patent: Jun. 11, 2013

(54) HANDHELD HEATER

(75) Inventors: Sydney L. Groves, Rancho Palos Verdes, CA (US); Stephen C. James, Highland Park, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 1186 days.

(21) Appl. No.: 12/070,300

(22) Filed: Feb. 14, 2008

Related U.S. Application Data

(63) Continuation-in-part of application No. 11/437,492, filed on May 18, 2006, now Pat. No. 7,570,875.

(60) Provisional application No. 60/682,097, filed on May 18, 2005.

(51) Int. Cl.
*H05B 3/42* (2006.01)
*F24H 9/02* (2006.01)
*F26B 3/30* (2006.01)

(52) U.S. Cl.
USPC ..... 392/410; 392/411; 392/420; 392/421; 392/424; 219/229

(58) Field of Classification Search
None
See application file for complete search history.

(56) References Cited

U.S. PATENT DOCUMENTS 2,364,730 A * 12/1944 Leskin ..... 219/227
3,265,891 A * 8/1966 Games ..... 250/317.1
3,396,455 A * 8/1968 Sherlock ..... 228/153
3,427,433 A * 2/1969 Spiller et al. ..... 392/421
3,674,974 A * 7/1972 Costello ..... 219/85.12
3,689,737 A * 9/1972 Eckles et al. ..... 392/409
3,816,705 A * 6/1974 Ebert ..... 219/521
3,822,035 A * 7/1974 Kopernak ..... 228/20.5
3,831,289 A * 8/1974 Knight ..... 34/278
4,052,593 A * 10/1977 Ebert ..... 219/521
4,089,047 A * 5/1978 Luderitz ..... 362/297
4,298,806 A * 11/1981 Herold ..... 250/504 H
4,460,820 A * 7/1984 Matsumoto et al. ..... 219/385
4,575,608 A * 3/1986 Wictorin et al. ..... 219/85.13
4,595,838 A * 6/1986 Kerschgens ..... 250/504 R
D293,020 S * 12/1987 Steinel et al. ..... D23/332
4,924,070 A * 5/1990 Friedman ..... 392/408
5,060,289 A * 10/1991 Abramson ..... 392/423
5,740,313 A * 4/1998 Ueda et al. ..... 392/419
5,820,829 A * 10/1998 Schodel et al. ..... 422/133
6,002,110 A * 12/1999 Sikka et al. ..... 219/411
6,335,514 B2 * 1/2002 McAmmond et al. ..... 219/229
6,426,486 B1 * 7/2002 Bartok ..... 219/405
6,654,550 B1 * 11/2003 Lemanski ..... 392/409
7,006,763 B2 * 2/2006 Miller et al. ..... 392/420
7,982,163 B2 * 7/2011 Chung et al. ..... 219/242

OTHER PUBLICATIONS

U.S. Non-Final Office Action for U.S. Appl. No. 11/437,492 mailed Aug. 25, 2008.
U.S. Notice of Allowance for U.S. Appl. No. 11/437,492 mailed Mar. 31, 2009.

* cited by examiner

*Primary Examiner* — Joseph M Pelham
(74) *Attorney, Agent, or Firm* — Michael Zarrabian, Esq.; Sherman & Zarrabian LLP

(57) ABSTRACT

A heating tool, including a housing having a handle, a heat source, a control circuit for controlling power of the heat source, one or more reflectors mounted in the housing to focus radiant energy from the heat source toward a focal region, an opening in the housing for receiving an object to be heated in the focal region, and a blower directing cooling air toward the reflectors and exiting the housing.

29 Claims, 33 Drawing Sheets

HANDHELD HEATER

CROSS-REFERENCE TO RELATED APPLICATIONS

This application is a Continuation-In-Part of U.S. patent application Ser. No. 11/437,492, filed on May 18, 2006, which claims benefit of U.S. Provisional Application Ser. No. 60/682,097, filed on May 18, 2005. Both of the above-identified applications are hereby incorporated by reference in their entirety.

BACKGROUND OF THE INVENTION

1. Field of the Invention

The present invention relates to a heating tool for heating shrinkable tubing and the like, and in particular to a handheld heater.

2. Description of Related Art

A heating apparatus for heating shrinkable tubing, or the like, is described in U.S. Pat. No. 6,246,486 issued to Bartok. Such a heating apparatus has a plurality of incandescent bulbs as heating sources, and reflectors used to concentrate the heat from the bulbs into a small focal region. Shrinkable tubing placed in this focal region is thereby heated. The apparatus is primarily used to heat electrical wiring bundles and the like. The apparatus may also be used for soldering, de-soldering, and for other purposes where concentrated high temperature is desired.

BRIEF SUMMARY OF THE INVENTION

The present invention provides a method and system for heating materials and components such as a shrinkable tubing. In one aspect, a heating tool includes a housing having a handle, at least one heat source, a control circuit for controlling the power of the at least one heat source, one or more reflectors mounted in the housing for focusing radiant energy from the at least one heat source toward a focal region, an opening in the housing for receiving an object to be heated in the focal region, and a blower directing cooling air toward the reflectors and exiting the housing.

In a preferred embodiment, the one or more reflectors are formed from a bent sheet of pre-polished metal. In another embodiment, the one or more reflectors are formed from a mosaic of pre-polished metal panels. Each of the plurality of reflectors may have one of the following approximate shapes: elliptical, ellipsoid, or parabolic.

In one embodiment, the at least one heat source comprises at least one of an incandescent bulb, a quartz, a glow bar or a microwave source.

The heating tool may further include a reflector housing including a plurality of metal castings, each for housing one of the one or more reflectors and for providing support to the blower.

In another embodiment, the heating tool further includes a connector disposed on the housing. The connector is adapted to be attached to a base on a surface (e.g., table, bench, floor, etc.) such that the heating tool can be operated in a hands-free mode. The heating tool may further include a jack for a footswitch for use in the hands-free operation mode.

In one embodiment, the heating tool further includes a thermistor providing a temperature feedback to the control circuit to control temperature from exceeding a predetermined threshold level.

Each of the plurality of reflectors may include a protrusion, wherein the reflector housing includes a receptor for receiving the protrusion.

In yet another embodiment, the housing further includes a removable side cap, the side cap includes at least one contact terminal for receiving at least one corresponding contact terminal of the at least one heat source.

In still another embodiment, the heating tool further includes a glare shield that is removably connected to the housing of the heating tool. The housing may have dimples near the opening for the glare shield to snap onto the housing. The glare shield includes at least one of a mirror, and a portion that is at least partially transparent to visible light.

In still yet another embodiment, the heating tool includes a nose portion enclosing at least a portion of the opening, where the nose portion is removably connected to the housing.

The housing may have pivot points on the housing, where at least a portion of the housing is removable from the heating tool through the pivot points.

In another embodiment, the heating tool further includes a reflector housing, where the reflector housing includes parallel air channels, and airflow adjusting members configured to direct air through the parallel air channels.

In yet another embodiment, at least a portion of the control circuit is included on a first circuit board disposed within the handle, and at least a portion of the control circuit is included on a second circuit board adjacent to a controller to provide a support for the controller.

In still another embodiment, the housing of the heating tool has a window adapted to allow viewing the opening from a backside of the heating tool.

In another aspect, the invention provides a method for operating a heating tool, including positioning the heating tool, placing an object to be heated through an opening of the heating tool, and controlling power and time duration of a heat source. The opening of the heating tool is located at a focal region of energy focused by one or more reflectors.

The method may further include covering the opening of the heating tool with a glare shield. The method may also include inspecting a progress of heating through at least one of a portion of the glare shield that is at least partially transparent for visible light, a mirror, and a backside window on the housing of the heating tool.

In one embodiment, the power and the time duration of the heat source is controlled through a footswitch when the heating tool is fixed to a surface using the connector.

The method may further include adjusting a size and a position of the focal region.

The method may still further include replacing a nose portion of the heating tool. The nose portion of the heating tool may have different sizes to fit in different objects to be heated.

The method may also include opening a jaw portion of the heating tool. The jaw portion may be opened by rotating about a pivot point, and/or may be removed from the heating tool for easy access to the inside of the heating tool for different purposes, e.g., cleaning, inspecting, etc.

In another aspect, the invention provides a handheld heating tool including means for generating radiant energy, means for focusing the radiant energy toward a focal region, means for moving the focal region about an object to be heated, means for passing air around the means for generating heat to provide cooling, means for preventing the heating tool from overheating, and means for fixing the tool to a surface.

The handheld heating tool may further include means for reducing glare from the means for generating radiant energy.

These and other features, aspects and advantages of the present invention will become understood with reference to the following description, appended claims and accompanying figures.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION OF THE INVENTION

Embodiments of the present invention provide a handheld heater for heating various materials and structures such as shrinkable tubing, cables, wires, etc. The heater can also be used in melting solders. Embodiments of the invention include novel arrangements of reflectors and bulbs that allow for flexible applications.

Figure 1:
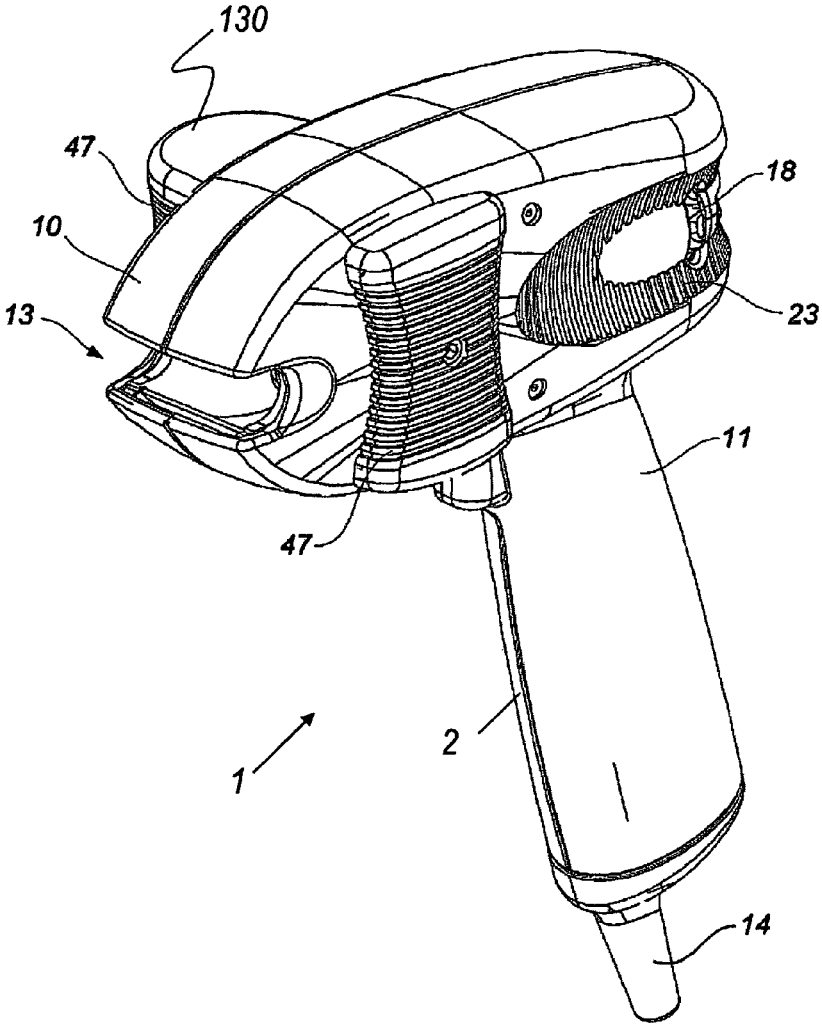
FIG. 1 is an external view of a handheld heating tool in accordance with an embodiment of the invention.
Figure 2:
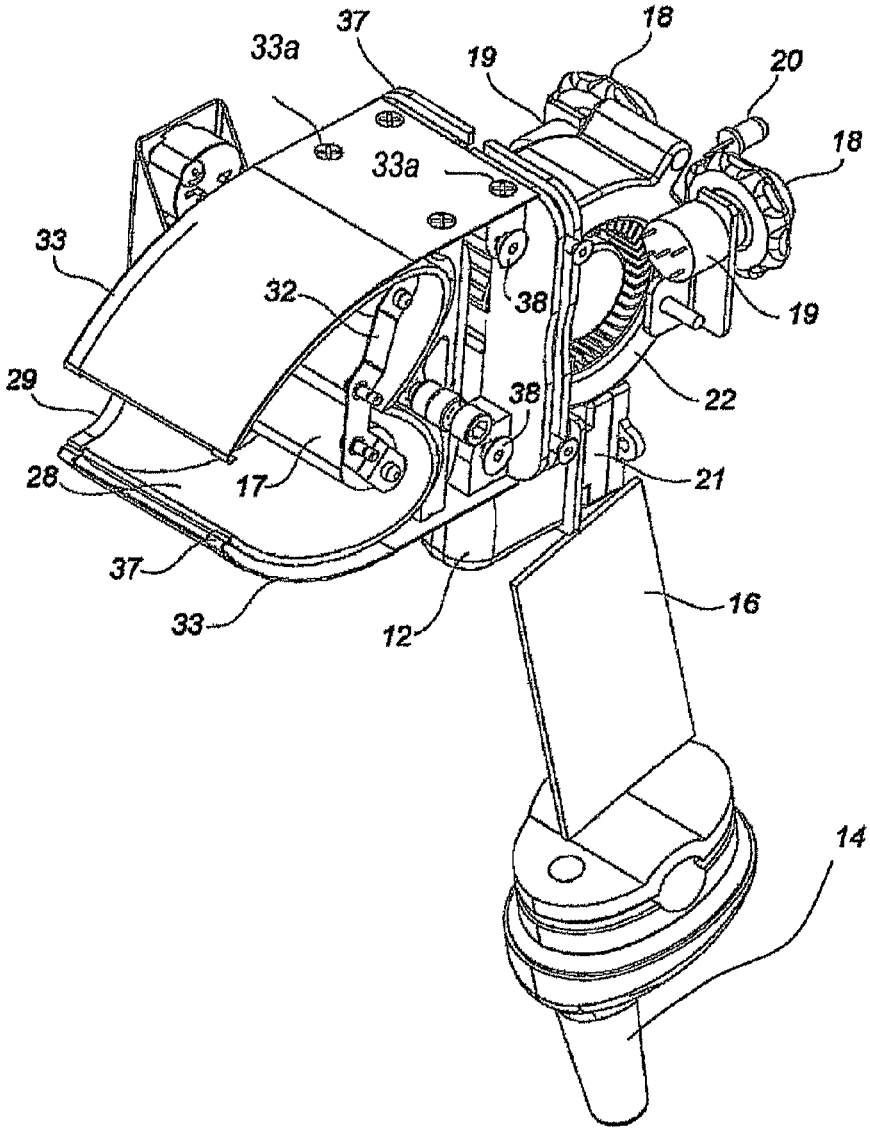
FIG. 2 shows an internal structure of the handheld heating tool.

As illustrated in FIG. 1, heater 1 has a right housing half 10 and left housing half 11 attached together. The two housing halves not only encompass major working elements of the heater, but also form handle 2. As illustrated in FIG. 2, trigger 12 is implemented on handle 2.

An opening in housing 10 and 11, shown as an exemplary transverse channel 13 across the nose of heater 1, is used to receive the object to be heated. This allows the heater to be placed around the object, instead of carrying the object to a bench top heater. It is noted that although channel 13 is shown as the opening to receive the object to be heated, the opening may be located in other positions of the housing, and may have different shapes and configurations. For example, the opening may be a curved surface, such as a complete circle to take advantage of back-reflected heat. In addition, using a complete circle may help to maintain the position of the object to be heated. In one embodiment, the opening may be configured as a flexible mouth that can be opened and closed. In other embodiments, the opening may be used together with, or is integrated to a cutting or compressing tool.

Housing halves 10 and 11 are preferably made of heat resistant injection molded plastic as these materials have relatively low thermal conductivity. In one embodiment internal structural elements in contact with the heating elements are made of metal in order to sustain high temperatures. In one embodiment side cap 130 may be removably coupled to housing half 10 for access to the heating elements.

Strain relief fitting 14 at the end of handle 2 connects to an electrical cord (not shown) for providing power to the heating tool. As illustrated in FIG. 2 (where the housing halves have been removed) a substantial portion of strain relief fitting 14 is clamped inside handle 2. A printed circuit board 16, which includes an electronic circuit to control the heater, is disposed inside handle 2.

Heat may be generated by one or more heating elements, such as a pair of incandescent bulbs 17 as shown in the exemplary configuration. In accordance with some embodiments of the invention, more than two bulbs may be included. In accordance with some other embodiments, other types of heat sources are implemented, such as a quartz heat source, a glow bar heat source a microwave heat source, etc.

Thumb wheels 18 at the rear of the housing are each connected to a controller 19 to control the heat source. In one embodiment one of the controllers can be used to control the magnitude of the current applied to the heat source, while the other controller can be used to control the time duration that current is supplied. The heat intensity and the time duration subsequently determine the heat received by the object being heated.

In another embodiment indicators on the thumb wheels and on the housing are used to indicate the settings chosen by the operator. In one embodiment light emitting diode (LED) 20 at the rear of the housing between the thumb wheels indicates whether the heater is connected to power (i.e., plugged in to an electrical socket).

Current is applied to the heat source via circuit board 16 and controllers 19 when switch 21 is closed by depressing trigger 12. For prolonged operations, cooling for housing 10 and 11 is implemented in one embodiment.

In one embodiment cooling for the housing is implemented with a low noise, centrifugal fan or blower 22 near the rear of the housing, which draws air through slots 23 in the housing. Cooling air is directed from blower 22 toward bulbs 17 and along paths within the housing, and exits through the channel 13 at the nose of the tool. As discussed in detail below, blower 22 is controlled by a circuit, which may also control turning on/off bulbs 17, to keep the temperature of the housing below a predetermined threshold. In one embodiment cooling time for the housing is longer than the heating time. Cooling of the housing, particularly of handle 2, is provided in this manner.

Figure 4:
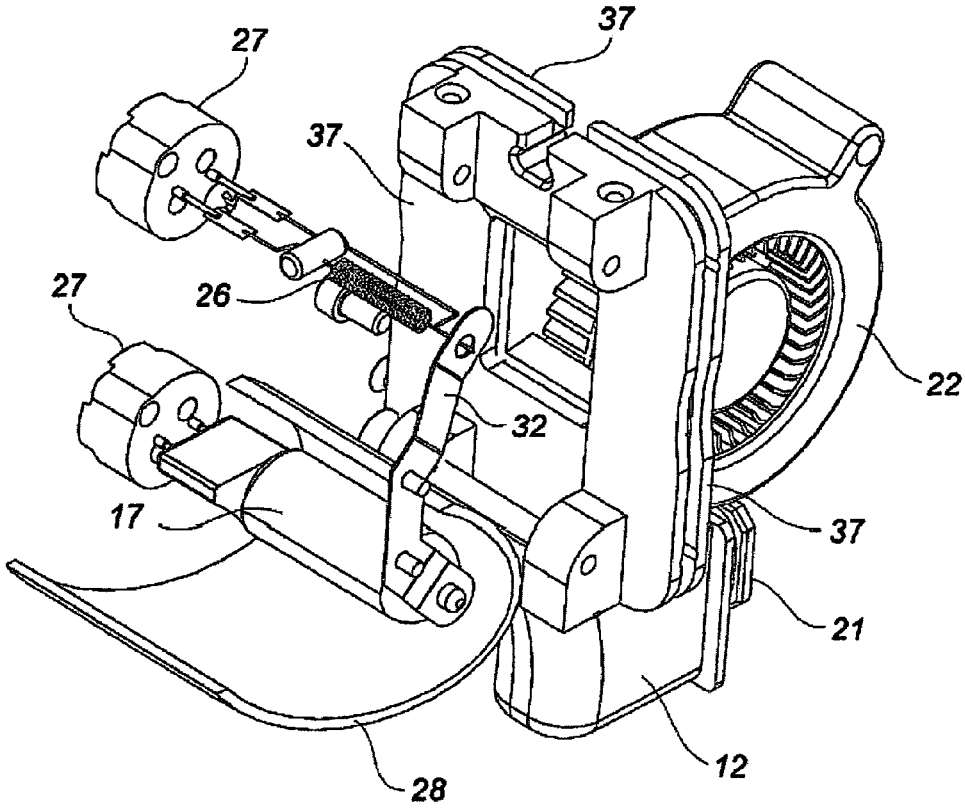
FIG. 4 shows additional underlying structure.

As illustrated in FIG. 4, two incandescent bulbs 17 each comprise a glass envelope with elongated filament 26. Each of the bulbs has its electrical leads plugged into socket 27. The incandescent bulbs are located within reflectors 28. The reflectors may be elliptical, parabolic, or have other shapes desired to focus the radiant energy/heat. In one embodiment each of the reflectors is bent to the desired shape from a flat sheet of pre-polished metal, such as aluminum. Alternatively, the reflectors may be made of mosaics of relatively flat panels to simulate a curved surface. By using pre-polished metal sheets, difficult polishing of convex surfaces can be avoided.

As illustrated, the reflectors are bent to shape in essentially a single direction normal to filament 26 in the bulb. If desired, the reflectors may be shaped with some additional concavity from side to side to concentrate radiant energy toward the focal region.

In accordance with an embodiment of the invention, each incandescent bulb is located such that its filament 26 lies along one of the foci of the respective elliptical surface. In one embodiment the major axes of the two ellipses are at an acute angle from each other so that the major axes intersect at the other focus of the respective ellipses. Radiation from the filament at one focus is concentrated at the other focus of the ellipse. Thus, radiation from the two bulbs is concentrated at a focal region where the major axes of the ellipses intersect. As illustrated the focal region lies within the channel 13 (FIG. 1).

In accordance with some embodiments, the location and the size of the focal region are adjustable by adjusting the position of the heat source or the position of the reflectors. This provides additional means for controlling the heating power and the direction of heating.

Because most of the radiant energy is directed toward one face of the object in the channel 13, the handheld heating tool may be rotated around the object for more uniform heating. In addition, the heater can be easily moved along the length of the object to be heated, for progressively heating the object along its length.

The elliptical reflectors are supported in elliptical grooves or against elliptical shoulders (not shown) in a pair of side panels at the side edges of the reflectors. The side panels and the reflectors may be preformed to maintain the elliptical shape of the reflectors. They also reduce heat loss through the housing. The right side panel 29 is illustrated along the edge of reflectors 28 in FIG. 2. The left side panel is omitted from the drawing so that the internal structure of the heating tool can be better seen.

Figure 8:
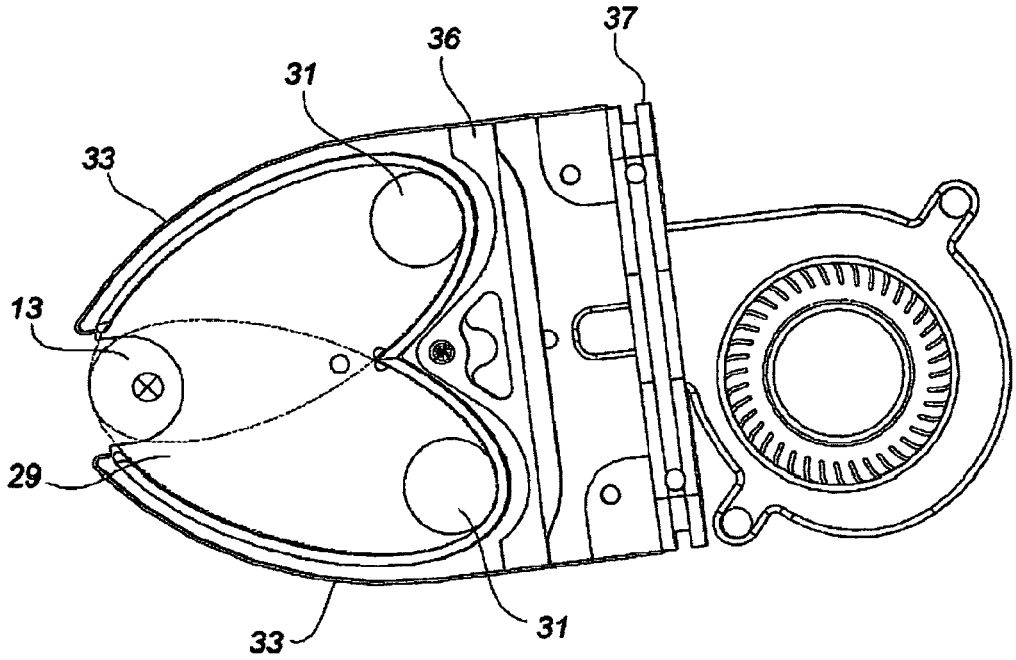
FIG. 8 is a fragmentary cross section similar to FIG. 7 with incandescent bulbs removed and one side panel restored.

Right side panel 29 has two openings 31 (FIG. 8) aligned with the bulbs. The electrical-lead ends of the bulbs pass through the openings to the respective sockets. The left side panel is essentially an identical mirror image of the right side panel except that it does not have openings like the openings 31 for the electrical-lead ends of the bulbs. Instead, the left side panel supports a bulb clip 32 (see, e.g., FIGS. 2-4), which holds the ends of bulbs 17 (opposite from the socket ends) in their correct position.

It may be noted that in various views in the drawings, conventional fasteners, such as those between the omitted left side panel and the bulb clip 32, have also been omitted from the drawings. Thus, for example, bolts 33*a* holding the reflector shield in place is illustrated in FIG. 2, but are omitted in subsequent drawings for clarity.

Figure 5:
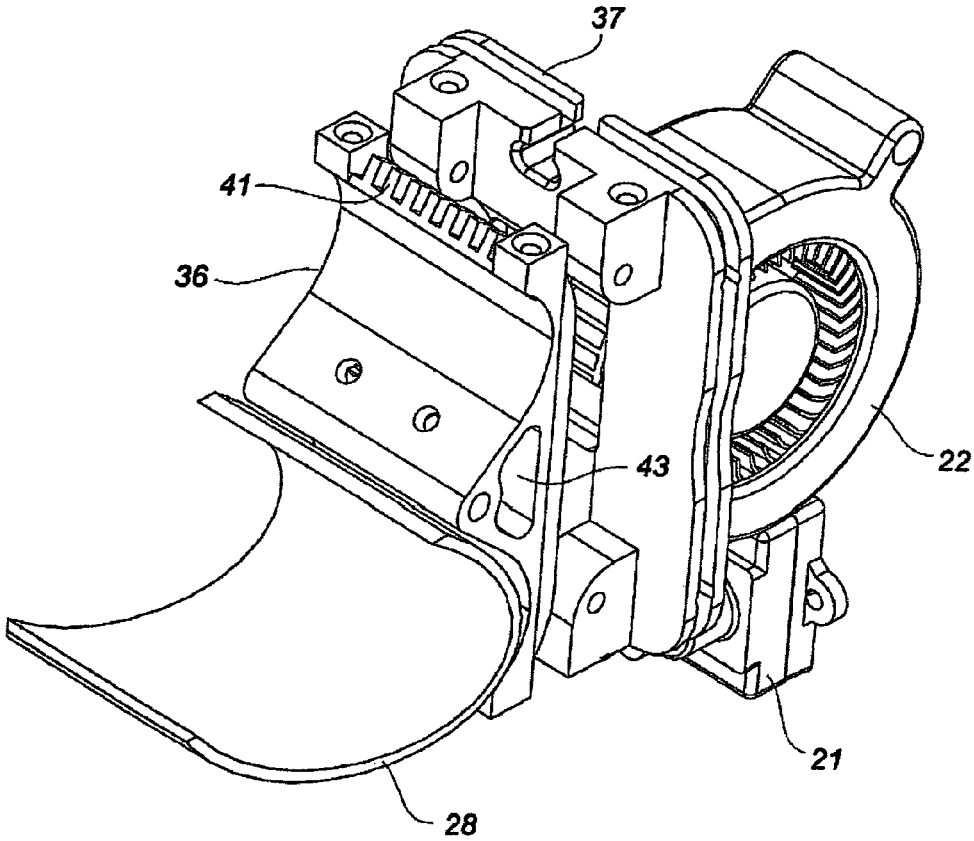
FIG. 5 shows another aspect of the underlying structure of the heating tool.
Figure 6:
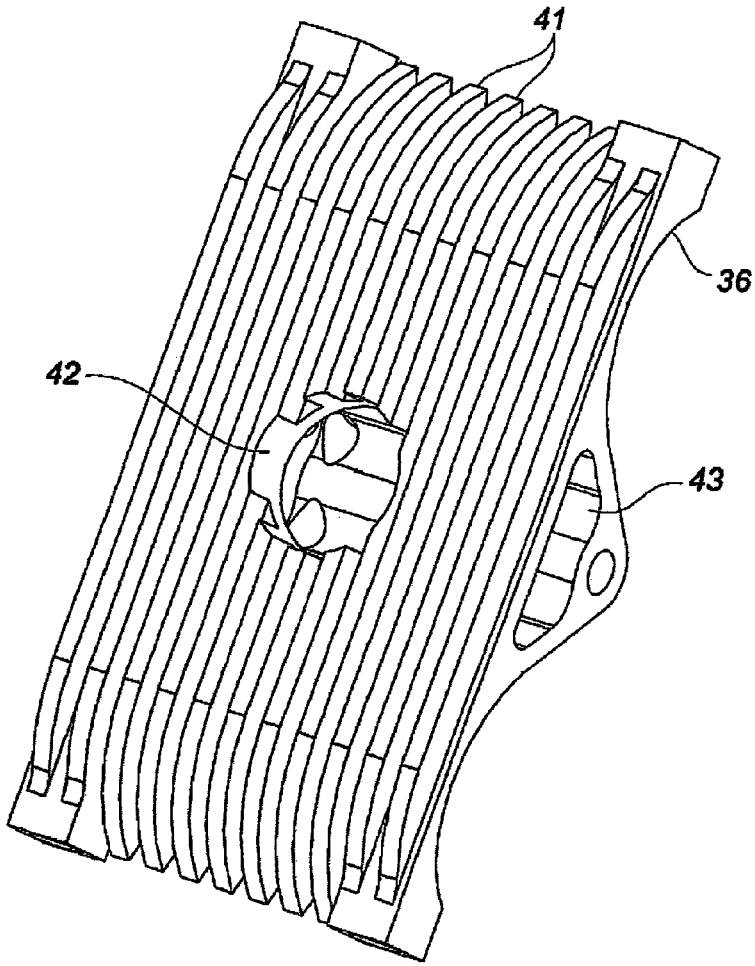
FIG. 6 is an isometric view of a face of an end frame support of the heating tool.

A reflector shield 33 lies along the outside contour of each edge of the side panels (i.e., two reflector shields, one above and one below the respective reflectors). A forward part of each reflector shield is curved to lie parallel to an outside face of the respective reflector. The reflector shields 33 are spaced apart from reflectors 28 to leave an air passage therebetween. Small curled tip 34 (FIG. 3) clips around an edge of a side panel adjacent to the channel through the nose of the heating tool. The other end of each reflector shield is fastened (by bolts 33*a*, for example) to end frame support 36 and rear support 37. End frame support 36 is best seen in FIGS. 5 and 6. The left and right side panels are fastened to the rear support by bolts 38, for example (FIG. 2). The side panels are also connected to the end frame support 36 by a subassembly of bolts and spacers.

Figure 3:
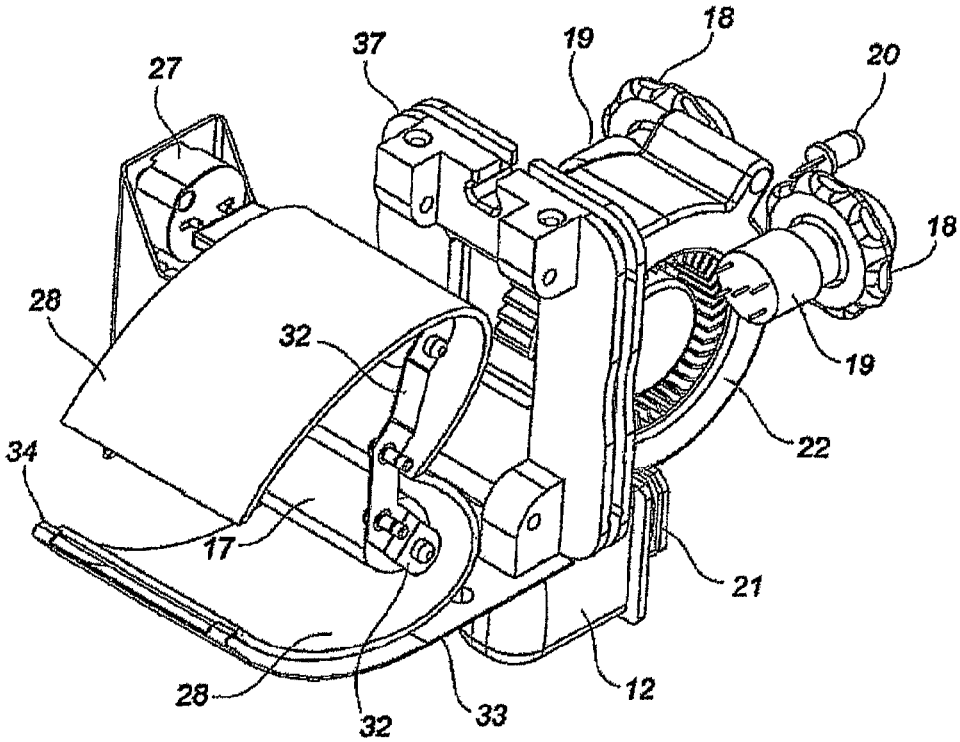
FIG. 3 shows a fragmentary view of the underlying structure.

Cooling air from the blower passes through a centrally-located rectangular opening through rear support 37, as can be seen in FIGS. 3 and 4. The air then encounters the back face of end frame support 36 which is best seen in FIG. 6. The back face has a pattern of parallel ribs 41 that extend in the up and down direction when the heating tool is assembled.

The forward face of the end frame support 36 has a shape generally similar to the outside surface of the reflectors. The end frame support 36 acts as a heat sink between the front and back of the tool. Waste heat passing through the reflectors may be conveyed by end frame support 36 to the cooling air from the fan by way of the fins on the back face. Air leaving the back face of end frame support 36 is then guided through the passages between the reflectors and reflector shields and is discharged at the edges of the channel at the nose of the heating tool.

The back of the end frame support 36 also has a central hole 42 (FIG. 6) in the path of air from the blower passing through the rear support. Such cooling air is then guided through a lateral passage 43 where some of the air enters the space between the right side panel 29 (FIG. 8) and the inside of the housing. Some of the air subsequently passes through openings 31 (FIG. 8) through right side panel 29 into the space inside the reflectors. This keeps the connector ends of the bulbs and their respective sockets from overheating.

Figure 7:
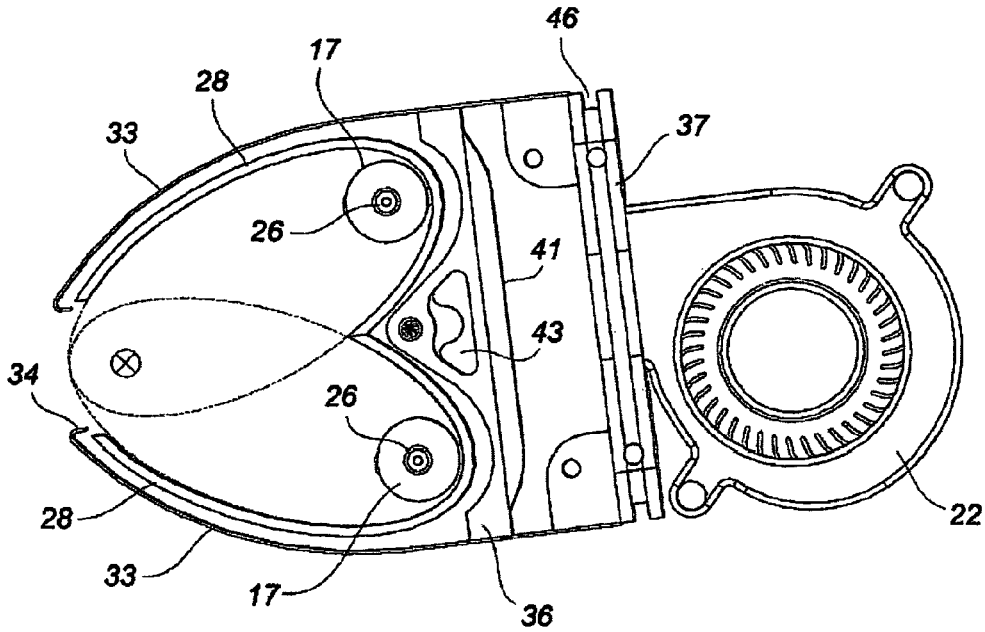
FIG. 7 is a fragmentary cross section through a part of the handheld heating tool illustrating the reflectors.

Cooling air is discharged from the heating tool at channel 13 (FIG. 8) across the nose of the tool. Ribs (not shown) within the two housing halves fit in a peripheral slot or groove 43 (FIGS. 6 and 7) around the rear support for minimizing air flow from the forward part of the tool into the cavity where the blower inlet is located. As illustrated in FIG. 7, groove 46 in the back plate locates and secures the reflector between the two halves of the handle by straddling a rib on the inside of each handle half. Groove 46 also helps seal the air flow from the blower out of the rear portion of the heating tool where the electronics are housed and forces air diverted by lateral passage 43 to flow through side cap 130 for cooling the bulbs, sockets, etc. This helps keep a relatively low temperature in the rear of heater 1, the control devices, and handle 2. In one example, heat is dissipated from a forward part of the tool through ribs 47 (FIG. 1) on one housing half, e.g., the side without the side cap 130 for bulbs. In another example, heat is dissipated from both sides of the housing.

Although warm air is discharged from the front of the heating tool, most of the energy for heating the object in the channel is conveyed as radiant energy rather than hot air. Thus, the object to be heated and structures near the object to be heated are not adversely affected by a blast of hot air.

Figure 9:
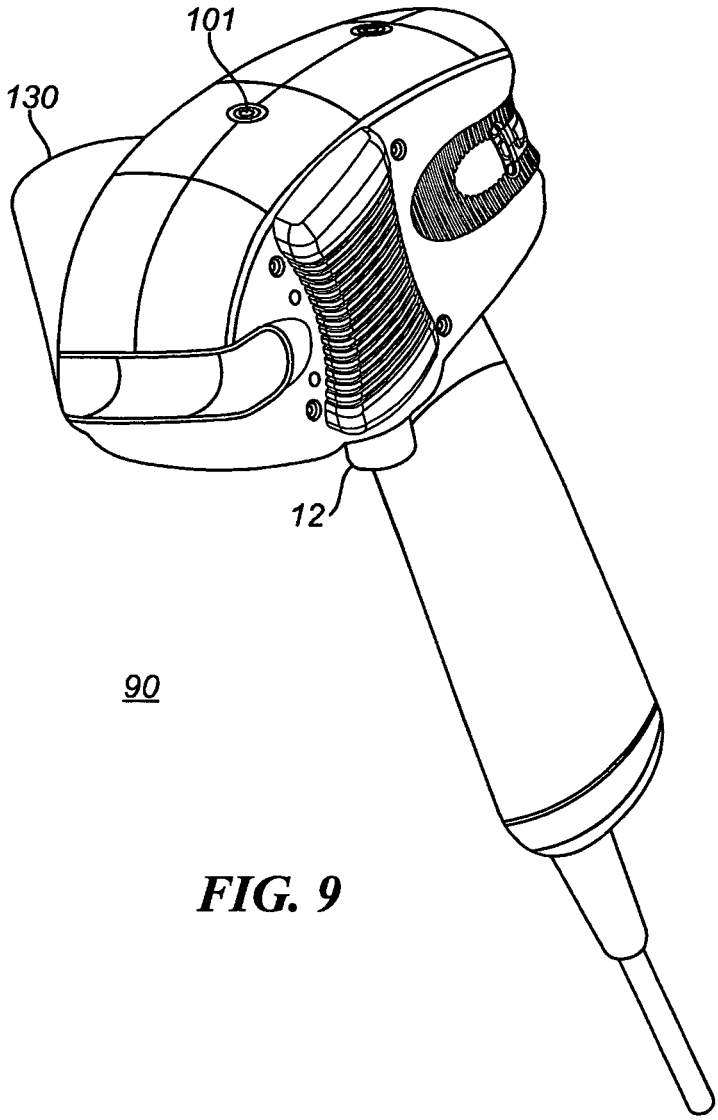
FIG. 9 is an external view of a handheld heating tool in accordance with a preferred embodiment of the invention.

FIG. 9 is an external view of a handheld heating tool 90 in accordance with a preferred embodiment of the invention. Heating tool 90 has a removable side cap assembly 130, which holds the bulbs, to be removed altogether. As shown, heating tool 90 comprises a connector 101 providing for attachment of an accessory base that allows the heater to be set on a surface, such as a table, bench, floor, etc., and used in a "hands-free" mode, as described in further detail below with reference to FIGS. 15A and 15B.

Figure 10:
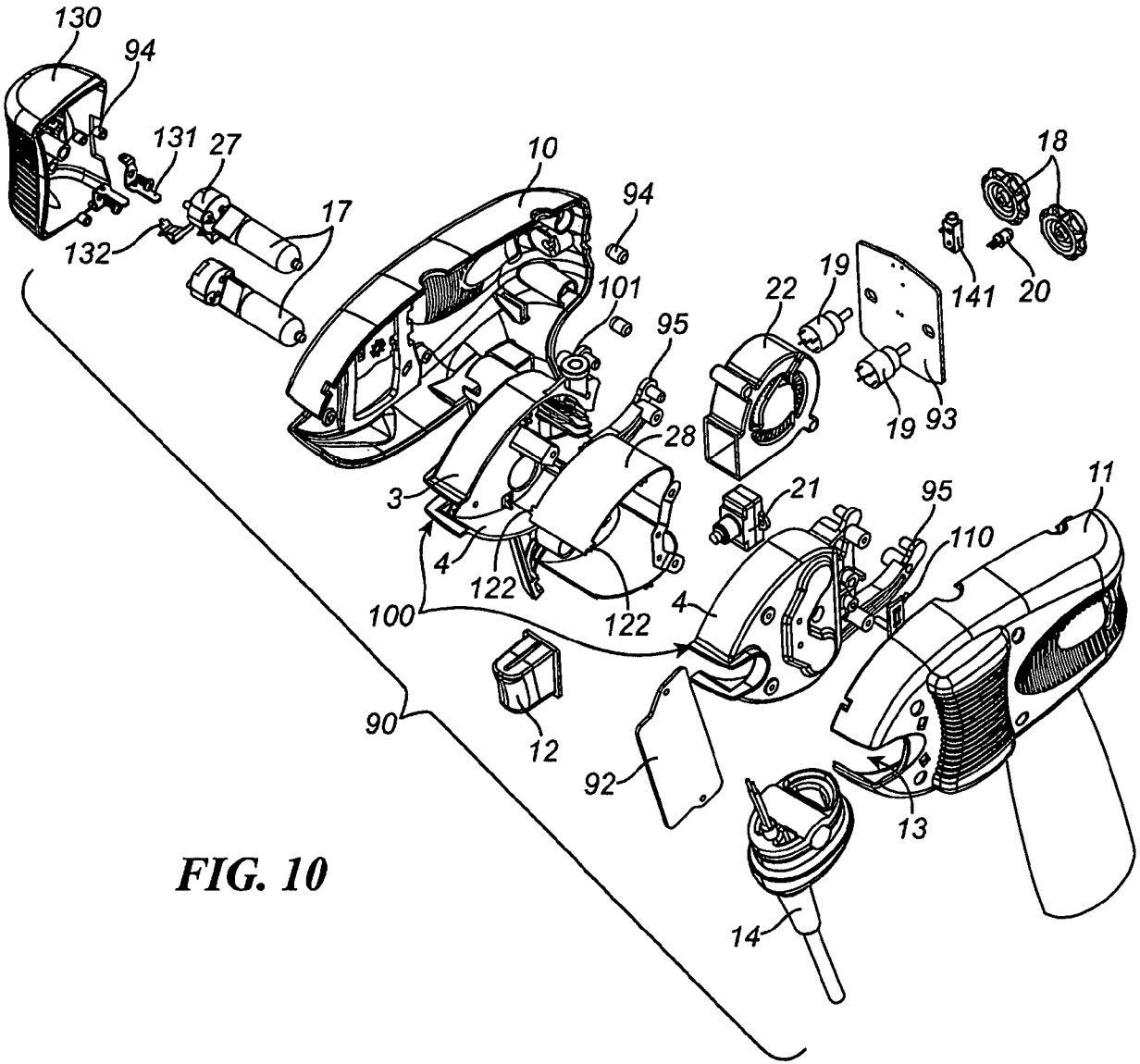
FIG. 10 is an exploded view of the handheld heating tool in accordance with a preferred embodiment of the invention.

FIG. 10 illustrates an exploded view of handheld heating tool 90 in accordance with the preferred embodiment of the invention. As discussed earlier, reflector shields 33 shown in FIG. 2, and end frame support 36, as well as rear support 37 shown in FIG. 5, are made of four machined components and two sheet metal components in one embodiment. In accordance with the preferred embodiment of the invention as illustrated in FIG. 10, these components are replaced with two metal castings as reflector housing halves 3, 4, referred to together as reflector housing 100. In this configuration, reflector housing halves 3 and 4 now support the blower or fan 22 using one or more support members 95 extended from reflector housing halves 3 and 4. Support members 95 are shaped to receive blower 22. Thus, assembly of heater 90 can be simplified as compared with embodiments in which blower 22 is mounted directly to handle 2.

In accordance with some embodiments of the invention, as shown in FIG. 10, main circuit board 16 is replaced with two separate circuit boards 92 and 93 to improve component layout, and to provide means to support controllers 19.

In the embodiment shown in FIG. 10, a plurality of inserts 94 is used in assembling heater 90. The exploded view also reveals trigger 12 and switch 21 as illustrated in FIG. 2.

In the embodiment shown earlier in FIG. 3, socket 27 is supported by a socket support bracket. In accordance with some other embodiments of the invention, the socket support bracket can be eliminated, and the two bulb socket can be supported by the side cap 130 itself, as shown in FIG. 10. One or more male terminals 131 and one or more female contact terminals 132 are included in heater assembly 90. Male terminals 131 are mounted in side cap 130, and female terminals 132 are installed in the right housing half 10. This configuration allows the side cap assembly, which holds the bulbs, to be removed. Thus, the bulbs and the reflectors can be easily cleaned, and it is easier to inspect and/or replace the bulbs. The side cap 130 can be attached and removed with a single screw recessed into the outside surface of the cap.

A connecting jack 141 for a footswitch may be added to the top rear portion of the handle, as also shown in FIG. 10 and later in FIGS. 12 and 13, to allow connection of an accessory footswitch (foot pedal) 153 (FIG. 15B) when the device is used on the accessory stand in its "hands-free" configuration.

Figure 11:
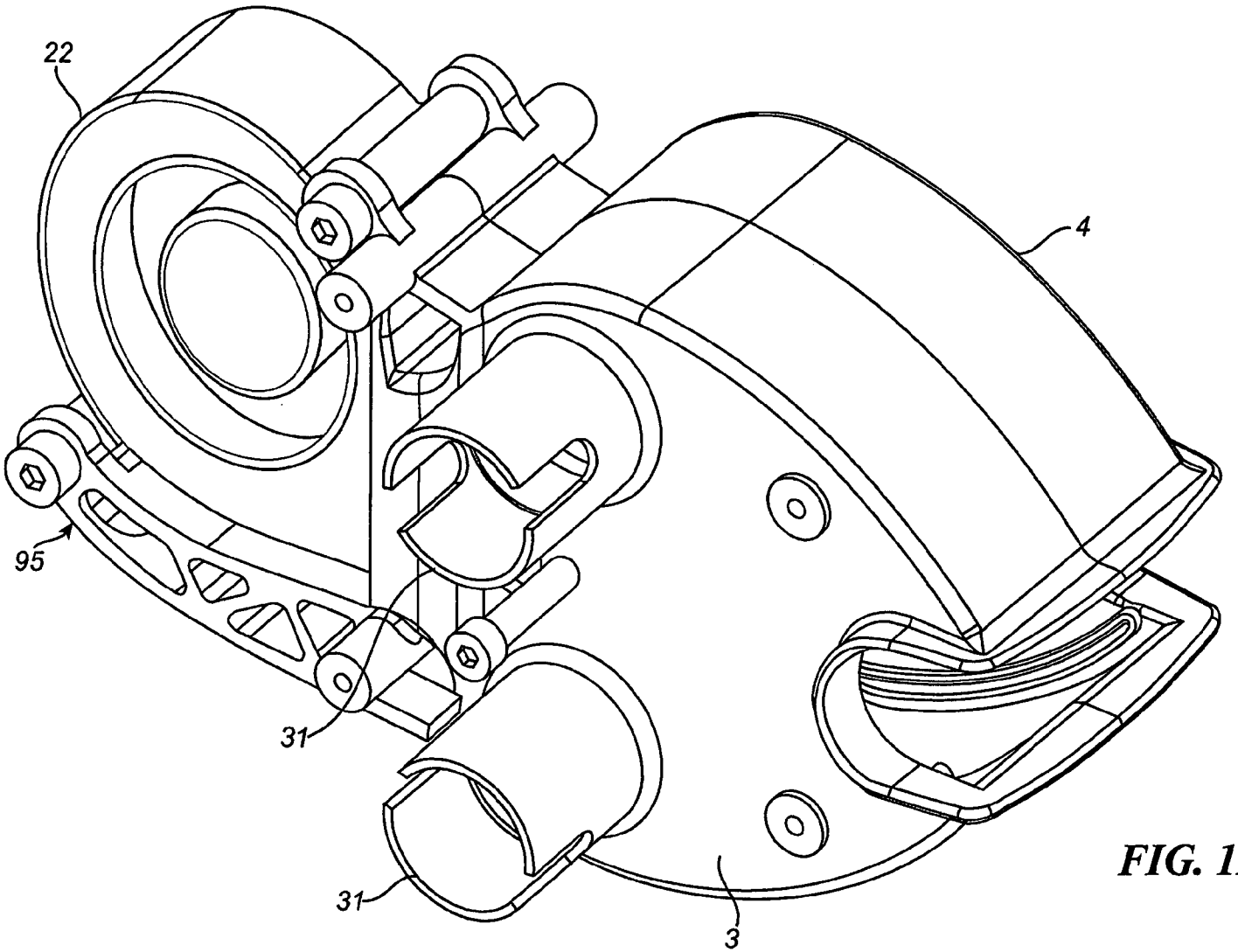
FIG. 11 is a perspective view of the reflector housing of the handheld heating tool.

FIG. 11 is a perspective view of the reflector housing of the handheld heating tool, including the housing halves 3, 4 and support members 95 extended from reflector housing halves 3 and 4. Housing half 3 has two openings 31 aligned with the heating elements 17 (FIGS. 14A, 14B).

Figure 12:
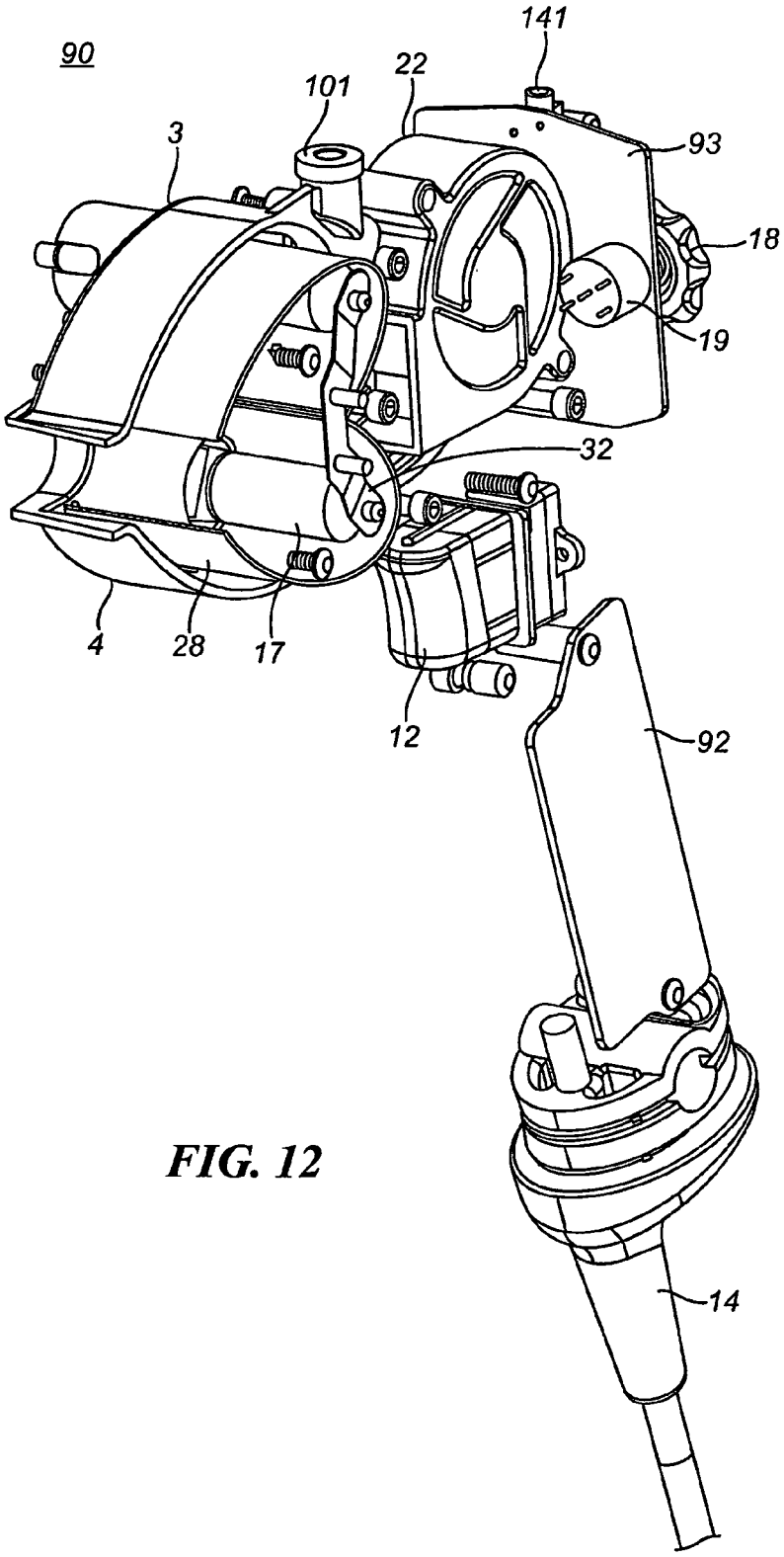
FIG. 12 shows an internal structure of the handheld heating tool including the reflector housing half and the reflector.

FIG. 12 illustrates an internal structure of handheld heating tool 90 including reflector housing half 3 and reflector 28. The left reflector housing half 4 has been removed for clarity.

Figure 13:
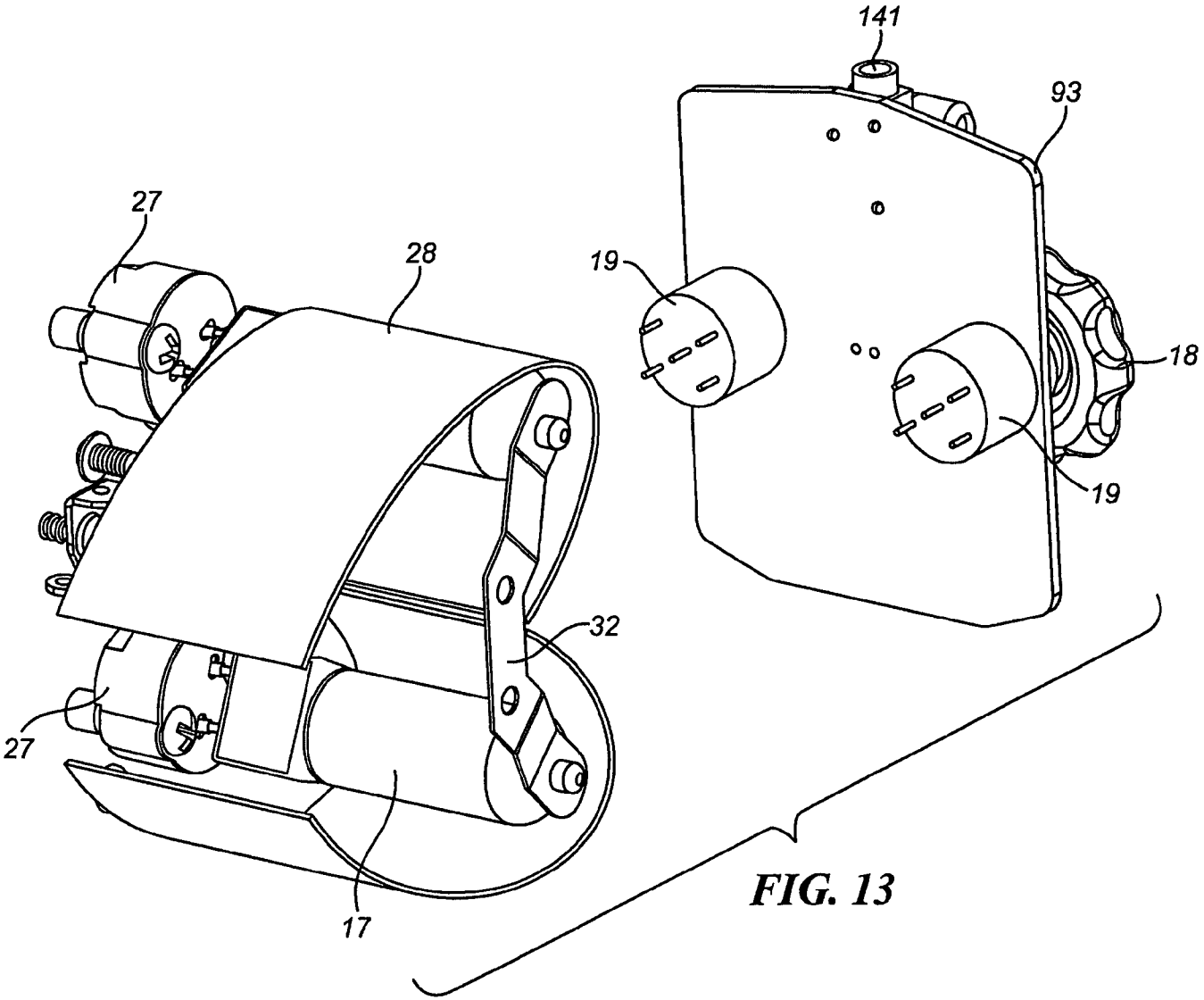
FIG. 13 shows a fragmentary view of the reflector.

FIG. 13 illustrates a fragmentary view of the reflector 28 and the heating elements 17.

Figure 14A:
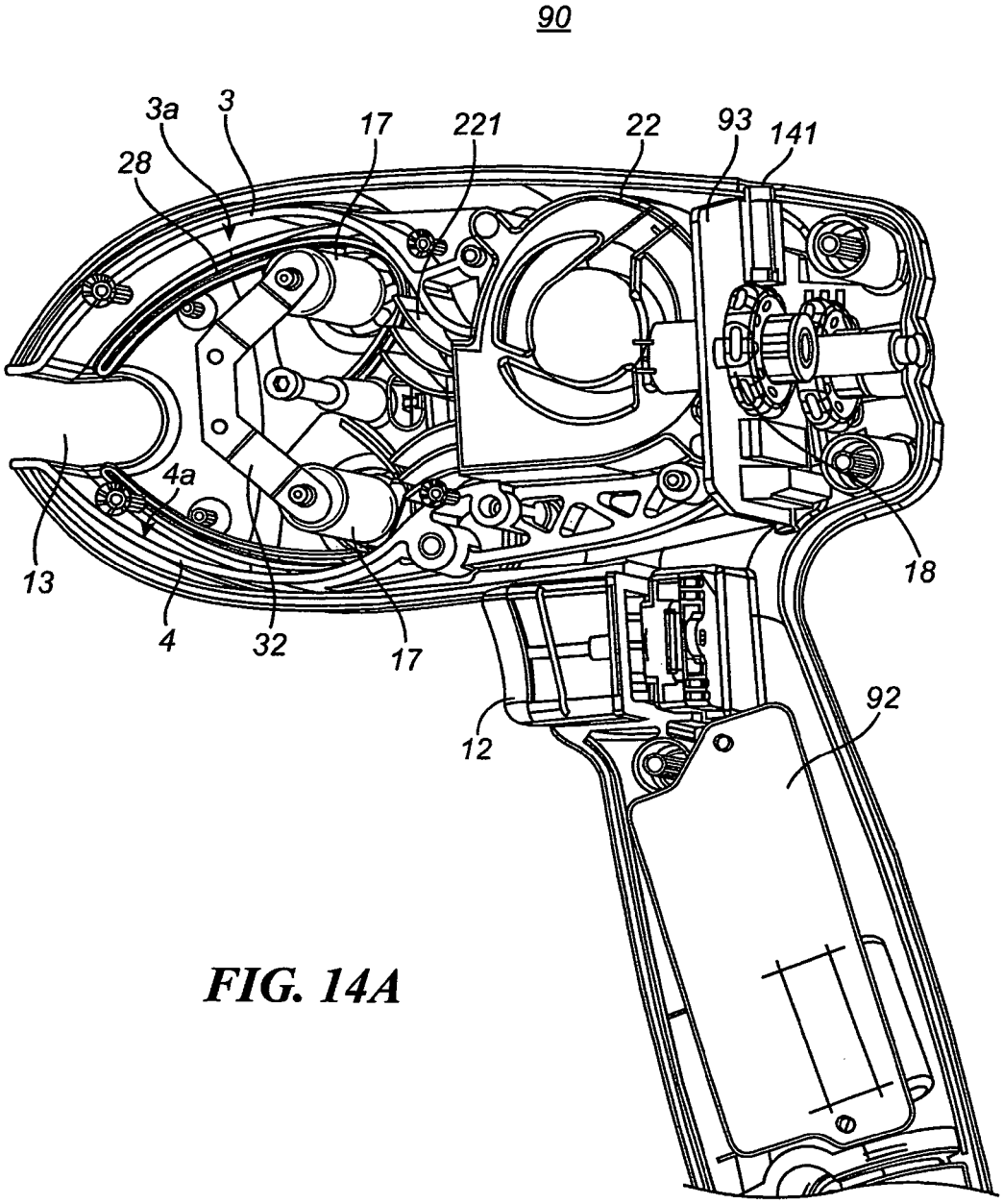
FIG. 14A shows a fragmentary view of an internal structure of the handheld heating tool.
Figure 14B:
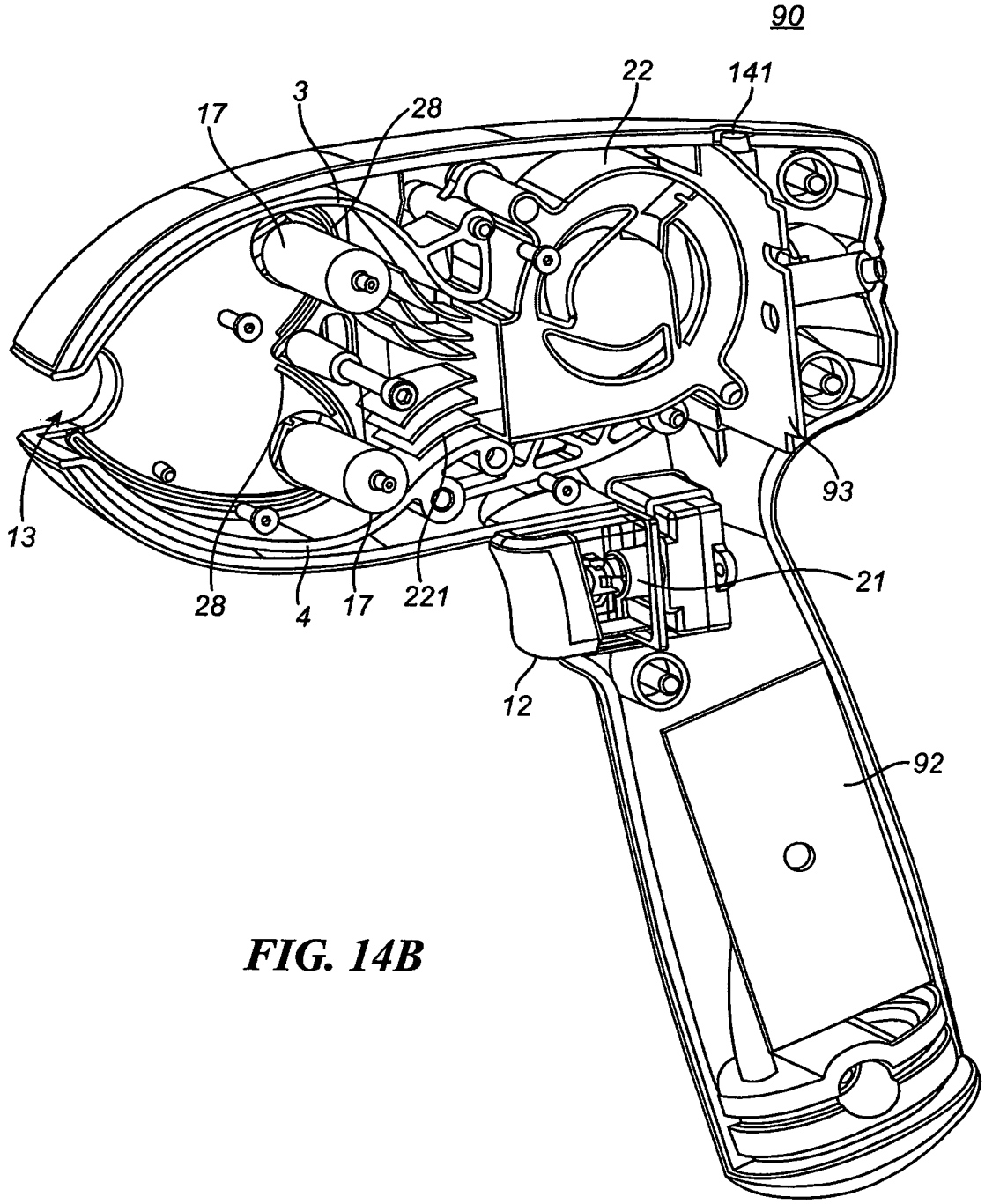
FIG. 14B shows a fragmentary view of the internal structure of the handheld heating tool from a different angle.

FIG. 14A illustrates a fragmentary view of an internal structure of handheld heating tool 90. As illustrated, a plurality of airflow baffles or adjusting members 221 are used to direct cooling airflow from blower 22 toward gaps 3*a*, 4*a* between housing halves 3, 4 and reflector 28. The air for the airflow may flow from the opening of the channel 13.

FIG. 14B illustrates a fragmentary view of the internal structure of handheld heating tool 90 from a different angle.

Figure 15A:
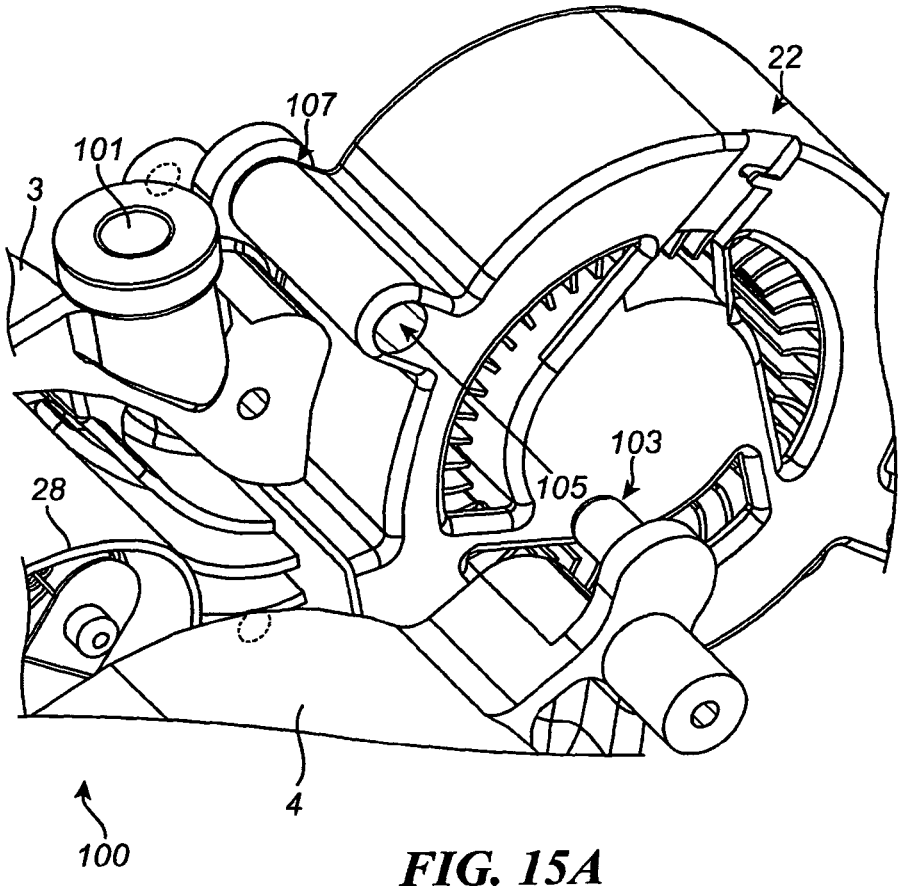
FIG. 15A shows a connector for converting the heating tool to a hands-free operation mode in accordance with an embodiment of the invention.

FIG. 15A illustrates connector 101 that is used for converting the heating tool for a hands-free operation mode in accordance with an embodiment of the invention. As shown, connector 101, which may be a boss, is implemented on reflector housing 100 including reflector housing halves 3, 4. The connector or boss 101 provides for attachment of an accessory base that allows the heater to be set on a surface, such as table, bench, floor, etc., and used in a "hands-free" mode.

Figure 15B:
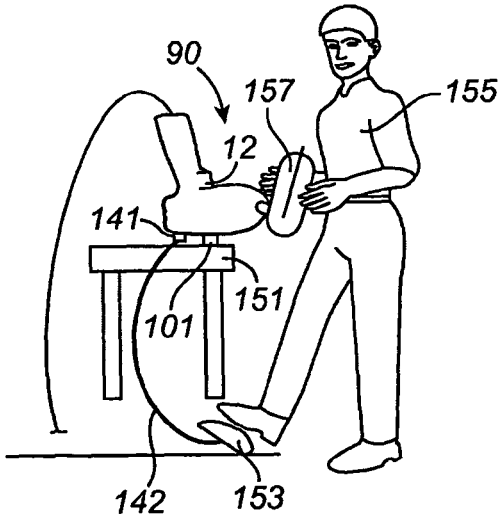
FIG. 15B illustrates the hands-free mode operation of the heating tool.

The hands-free mode operation of heating tool 90 is illustrated in FIG. 15B. As shown, heating tool 90 is fixedly coupled to a table 151 at connector 101. Jack 141 is electrically connected to footswitch 153 through a cable 142. Thus, the operator 155 can hold the object 157 to be heated with both hands, while controlling heating tool 90 using footswitch 153 instead of trigger 12.

As also illustrated in FIG. 15A, an extrusion 103 on the left reflector housing half 4 is used to couple left reflector housing half 4 to blower 22 through receptor 105. Similarly, right reflector housing half 3 is coupled to blower 22 with the extrusion 107.

Figure 16A:
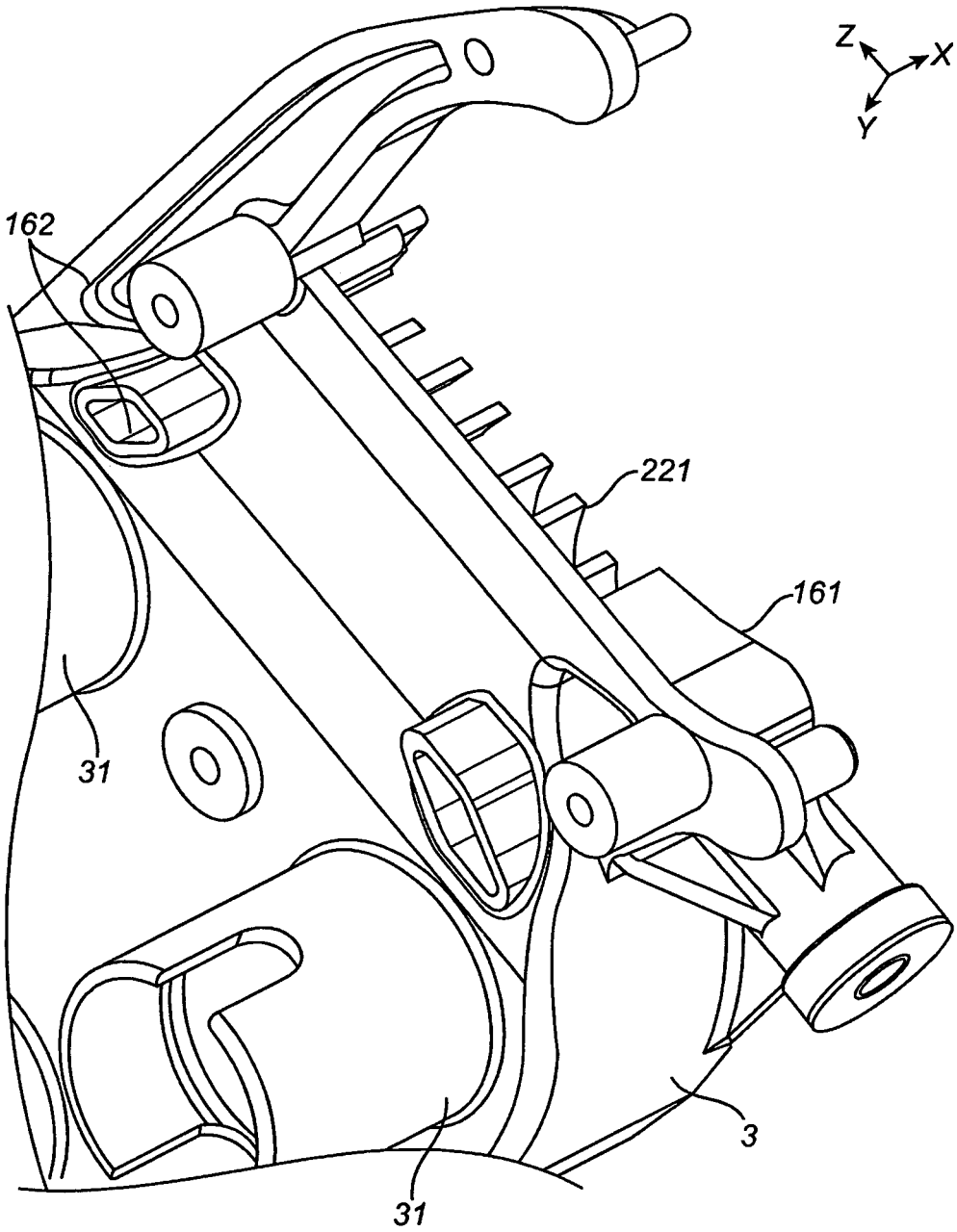
FIG. 16A shows details adjacent the outlets of the air channels.

FIG. 16A illustrates details of adjacent outlets of air channels 161, 162. Multiple airflow-adjusting members 221 are used to direct air through air channels 161 and 162, and direct air to flow in gap 3*a* between the reflector housing halves 3, 4 and the reflector 28 (FIG. 14A). Air channels 161, 162 divert a portion of the cooling air from the airflow-adjusting members 221 to provide some cooling for heating elements 17 adjacent the openings 31.

Figure 16B:
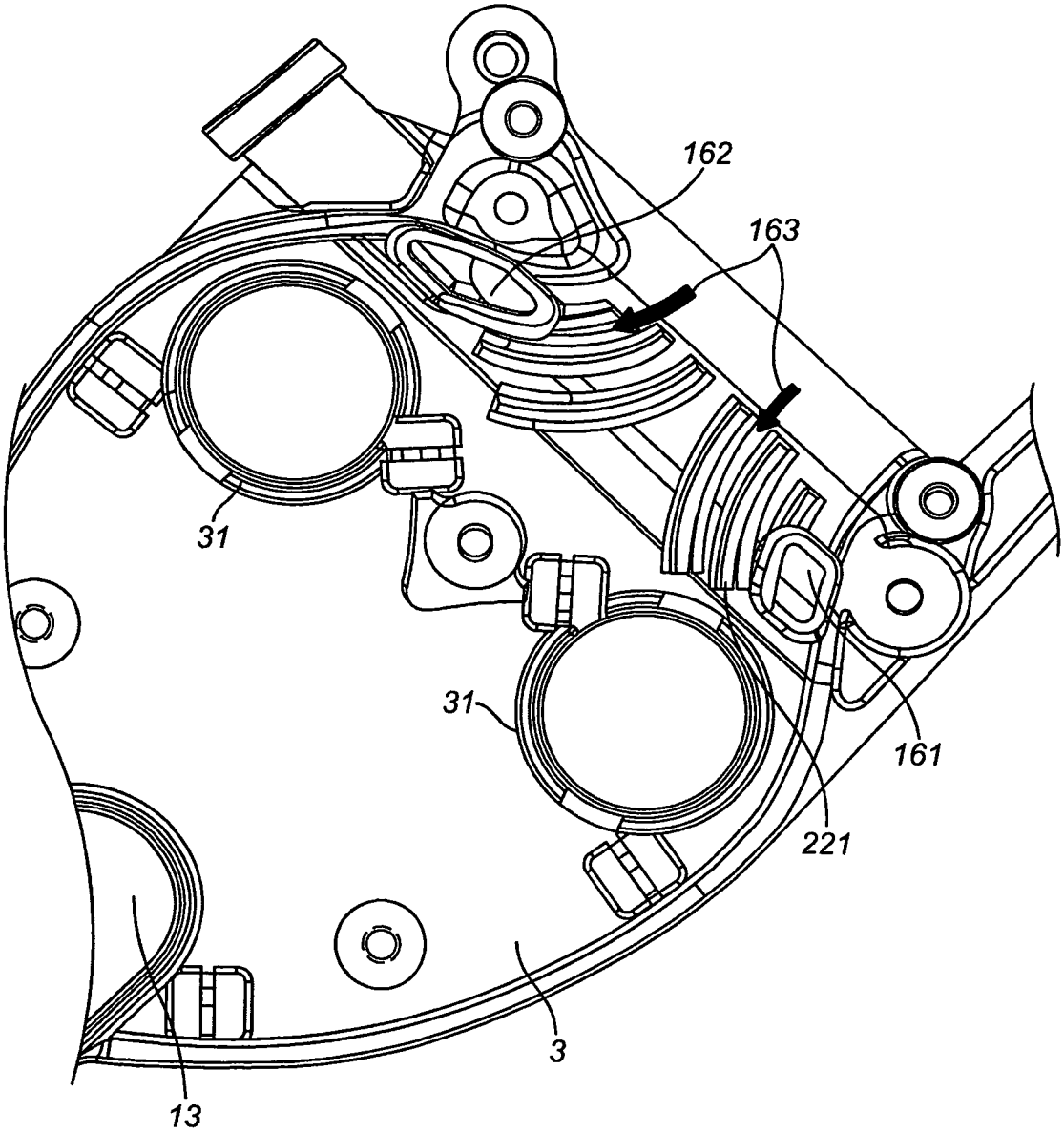
FIG. 16B shows the air channels from a different angle.

FIG. 16B illustrates air channels 161, 162 from a different angle. Block arrows 163 indicate a first airflow direction along the airflow-adjusting members 162.

Figure 16C:
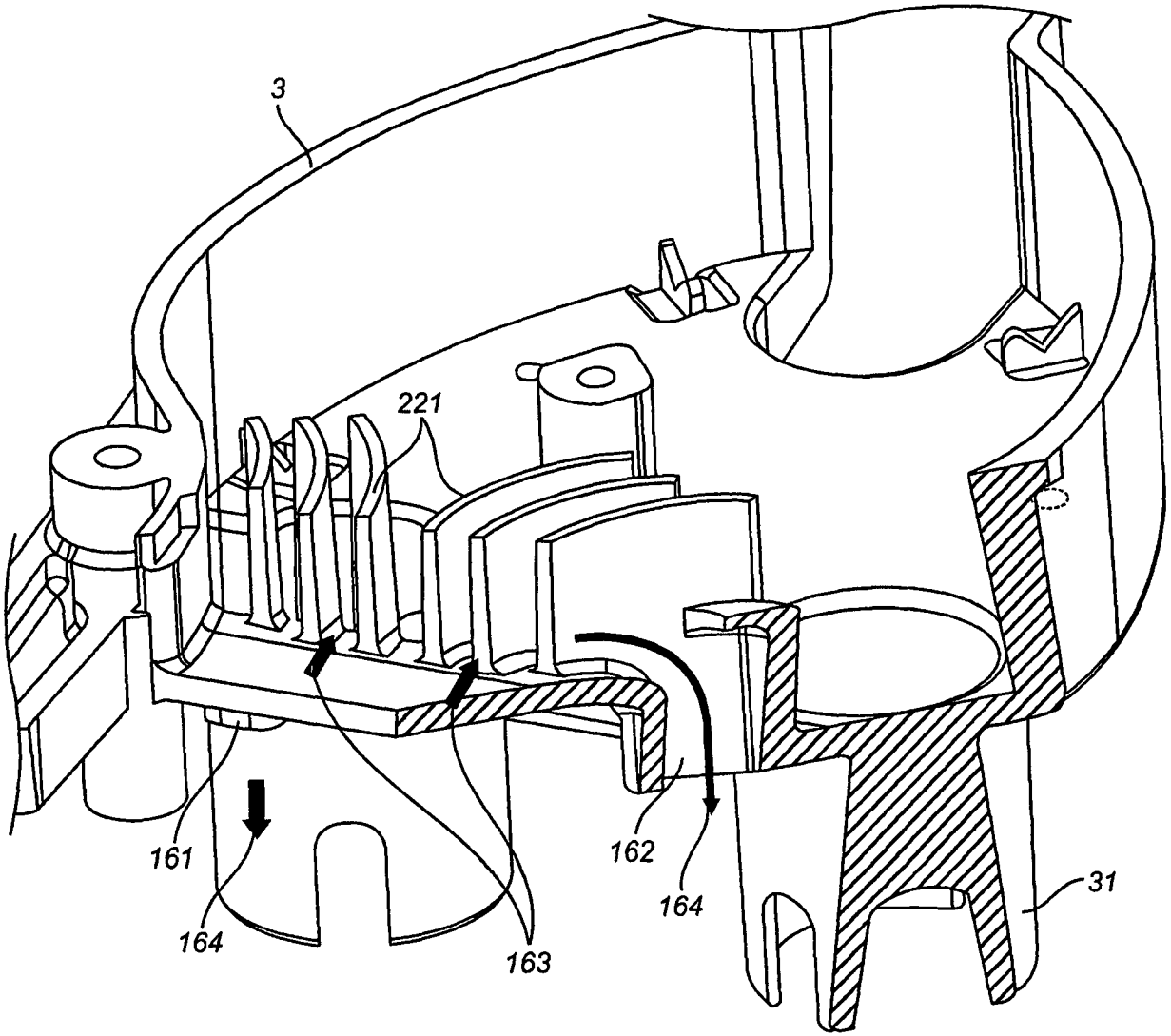
FIG. 16C illustrates the air flow through the air channels.

FIG. 16C illustrates the airflow through air channels 161, 162. Part of the airflow 163 between airflow-adjusting members 221 are diverted through air channels 161, 162 in a second direction exiting the air channels 161, 162, shown as block arrows 164.

Figure 16D:
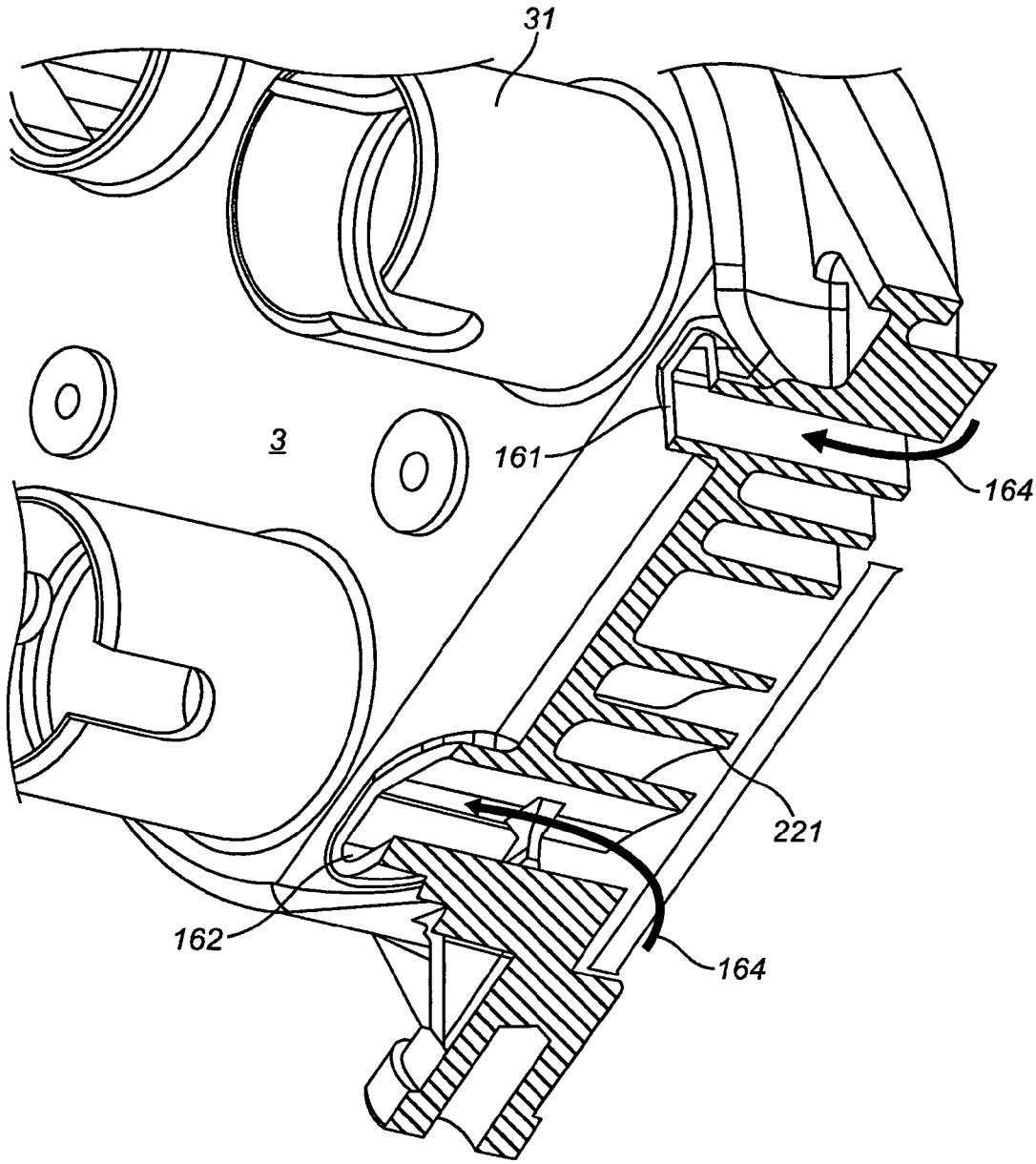
FIG. 16D illustrates the air flow through the air channels from another angle.

FIG. 16D illustrates the airflow 164 through the openings of the air channels 161, 162 from another angle.

Figure 17:
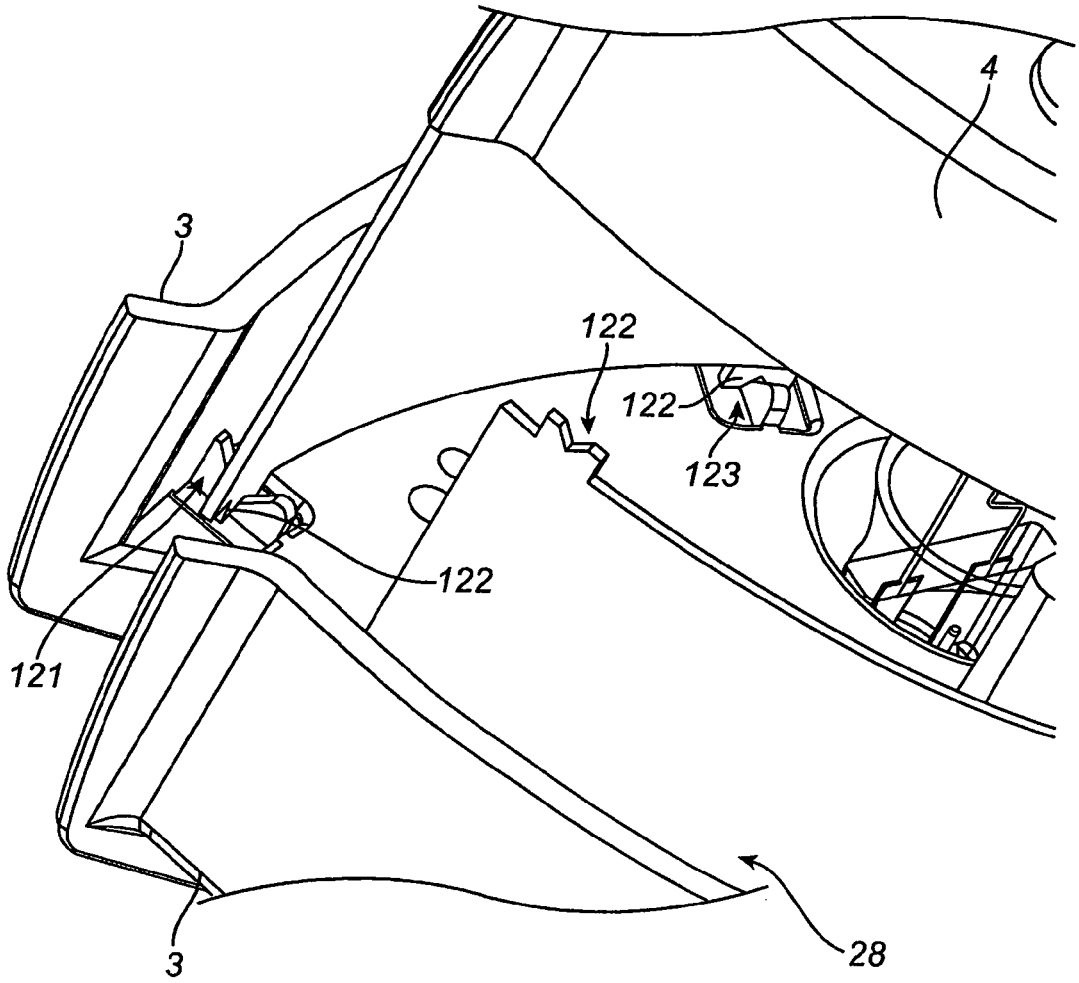
FIG. 17 illustrates coupling between the reflector and the reflector housing in accordance with an embodiment of the invention.

FIG. 17 illustrates the connection between reflector 28 and the reflector housing halves 3, 4 in accordance with an embodiment of the invention. In accordance with some embodiments of the invention, polished sheet metal reflectors are retained by a groove machined into the side of the reflector housing. In accordance with a preferred embodiment shown in FIG. 17, instead of using a groove, a set of small ribs 121 on reflector housing half 3 oriented perpendicular to the reflectors 28 are used to mate with the V-shaped protrusions 122 on reflectors 28 to make the connection. A snap joint 123, for example, may thus be formed between reflector housing half 3 and reflectors 28. This configuration simplifies the assembly procedures, and reduces thermal conduction by the reflector housing half 3.

Figure 18:
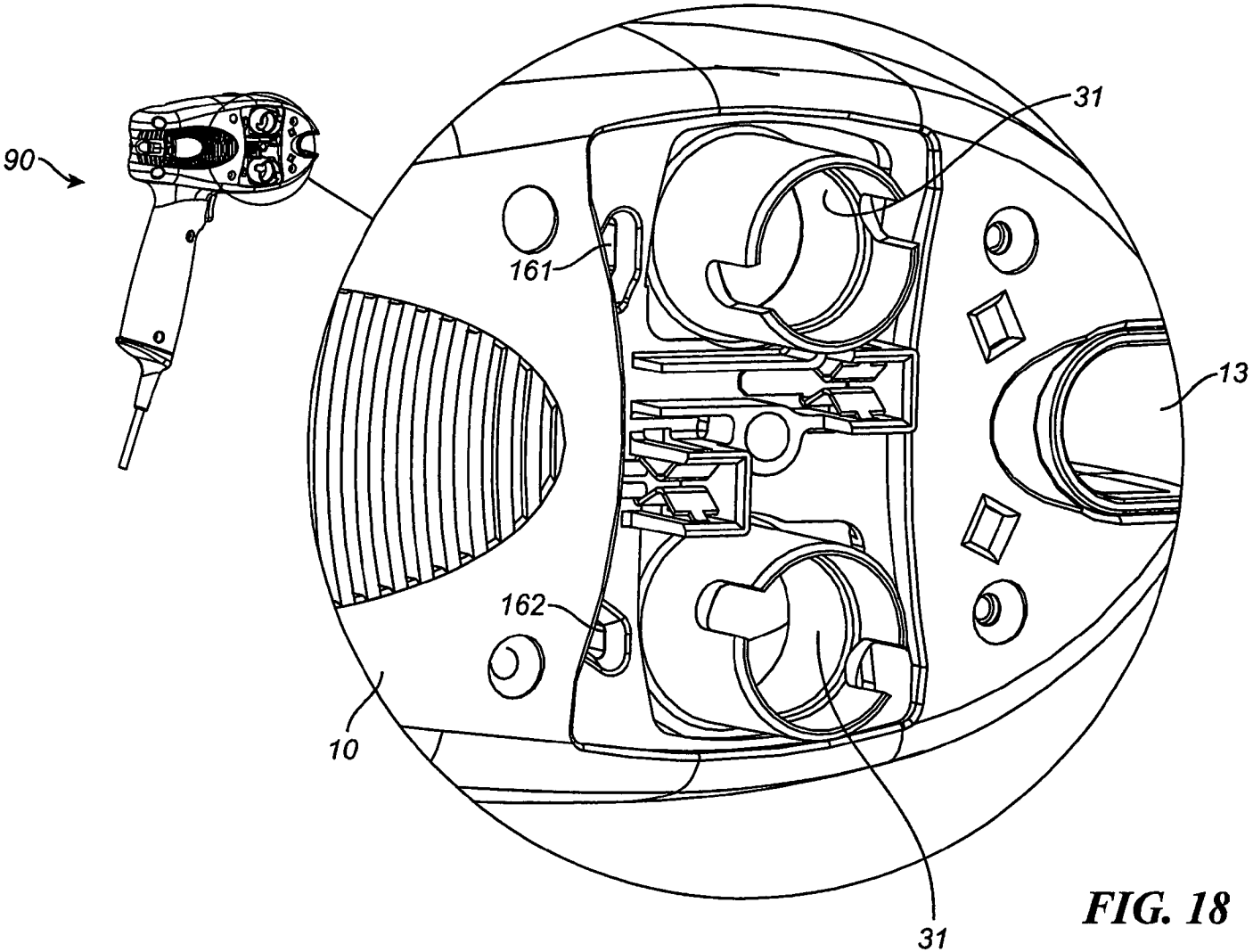
FIG. 18 illustrates outlets of the air channels on the right side of the heating tool with the side cap removed.

FIG. 18 illustrates outlets of air channels 161, 162 on the right side of heating tool 90 with side cap 130 removed.

Figure 19A:
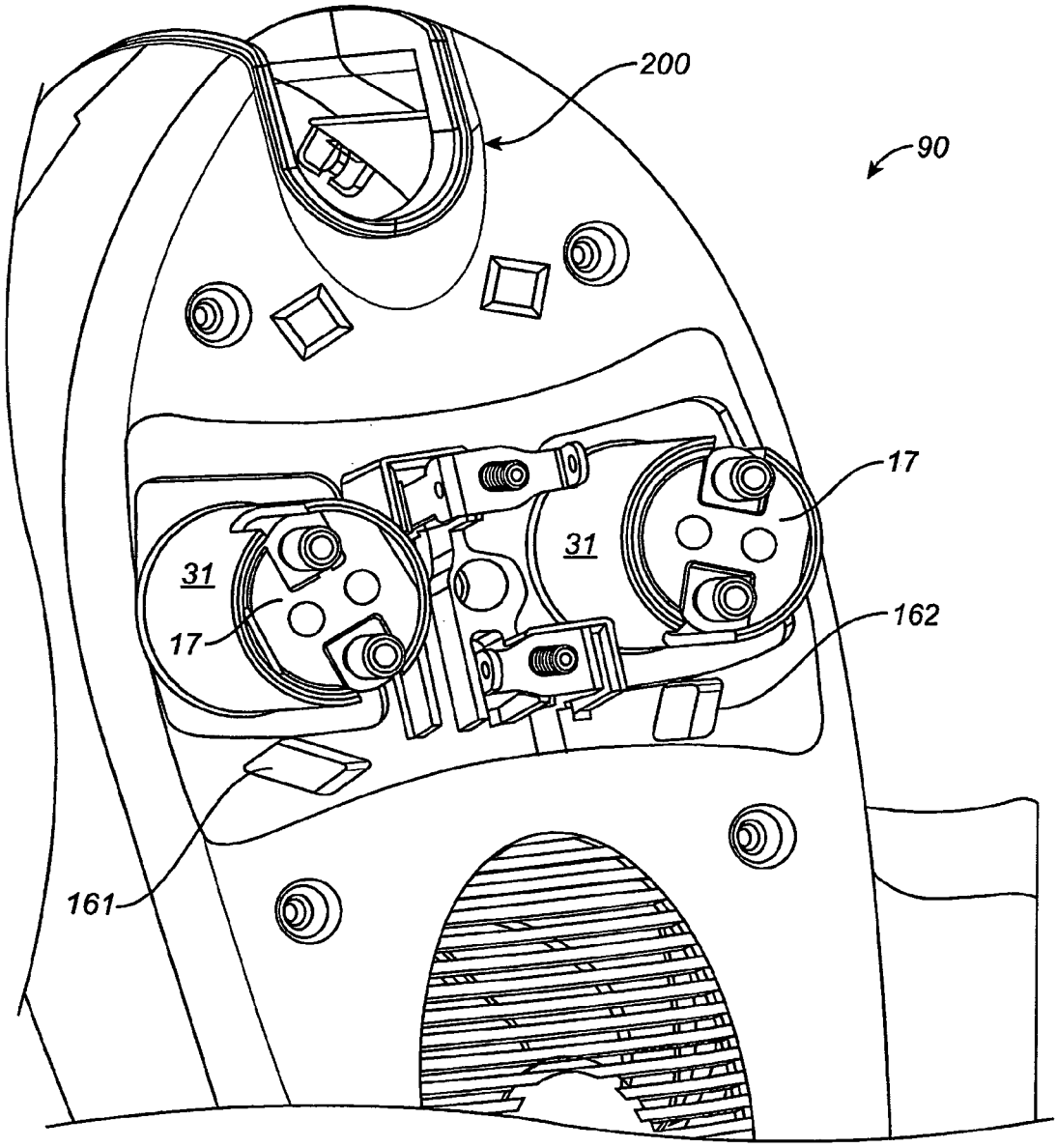
FIG. 19A shows the outlets of air channels with the side cap removed from another angle, and a replaceable nose portion of the heating tool.

FIG. 19A illustrates the outlets of air channel 161, 162 with side cap 130 removed, from another angle, and a replaceable nose portion 200 of an embodiment of heating tool 90. Interchangeable nose portion 200 may be selected from a kit, or a set of nose portions having different sizes and shapes used for different objects to be heated. By replacing nose portion 200 of the heater 90, the resulting opening 13 of heating tool 90 may have shapes and locations different from that shown in the illustrated embodiments.

Figure 19B:
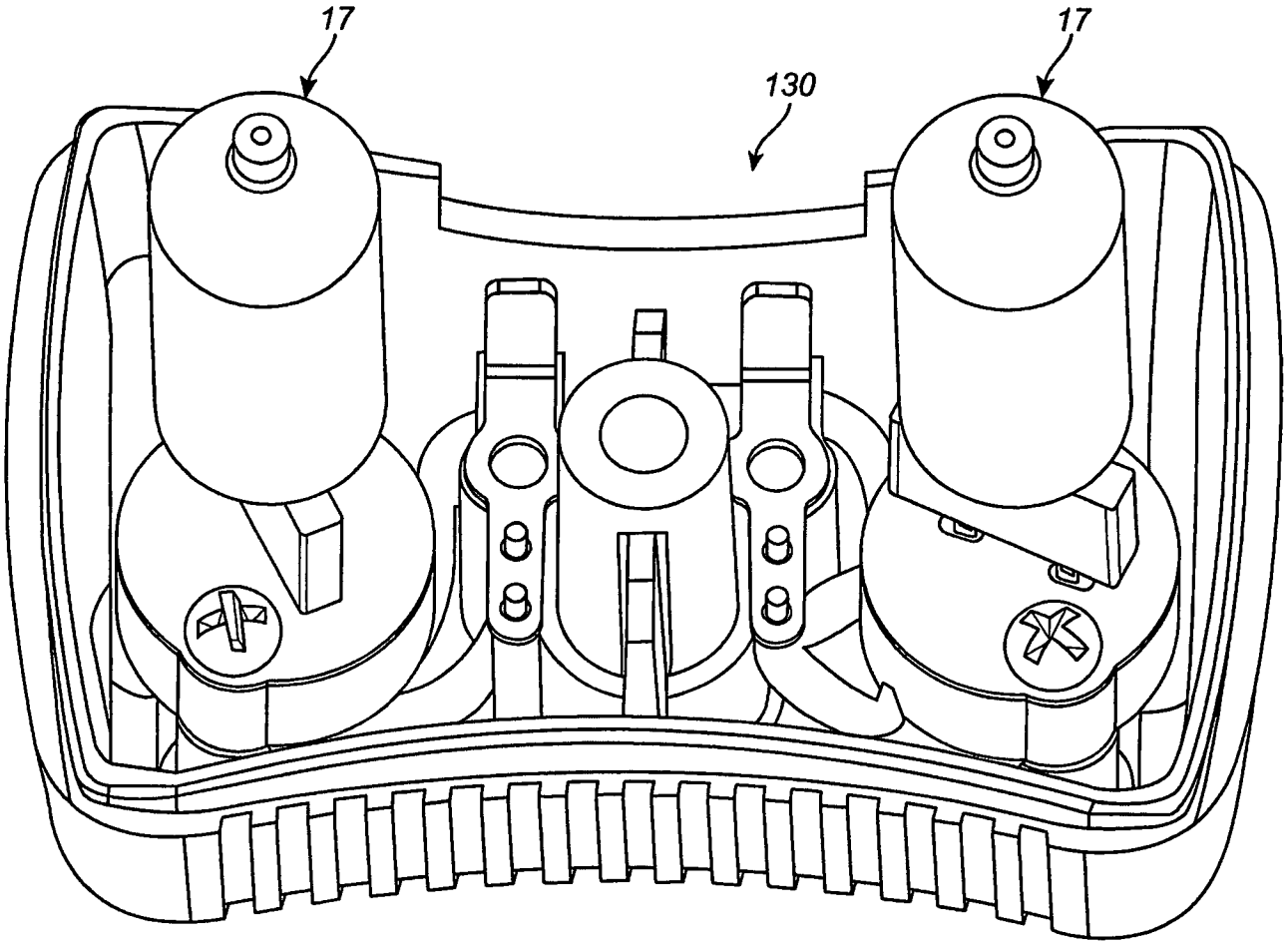
FIG. 19B shows the removed side cap.

FIG. 19B illustrates removed side cap 130 together with heating elements 17. Heating elements 17 are coupled to side cap 130 using female terminals 132 and male terminals 131 (FIG. 10). As discussed earlier, by removing side cap 130 and heating elements 17 together, embodiments of the invention allow easier assembling and cleaning of heating tool 90.

Figure 19C:
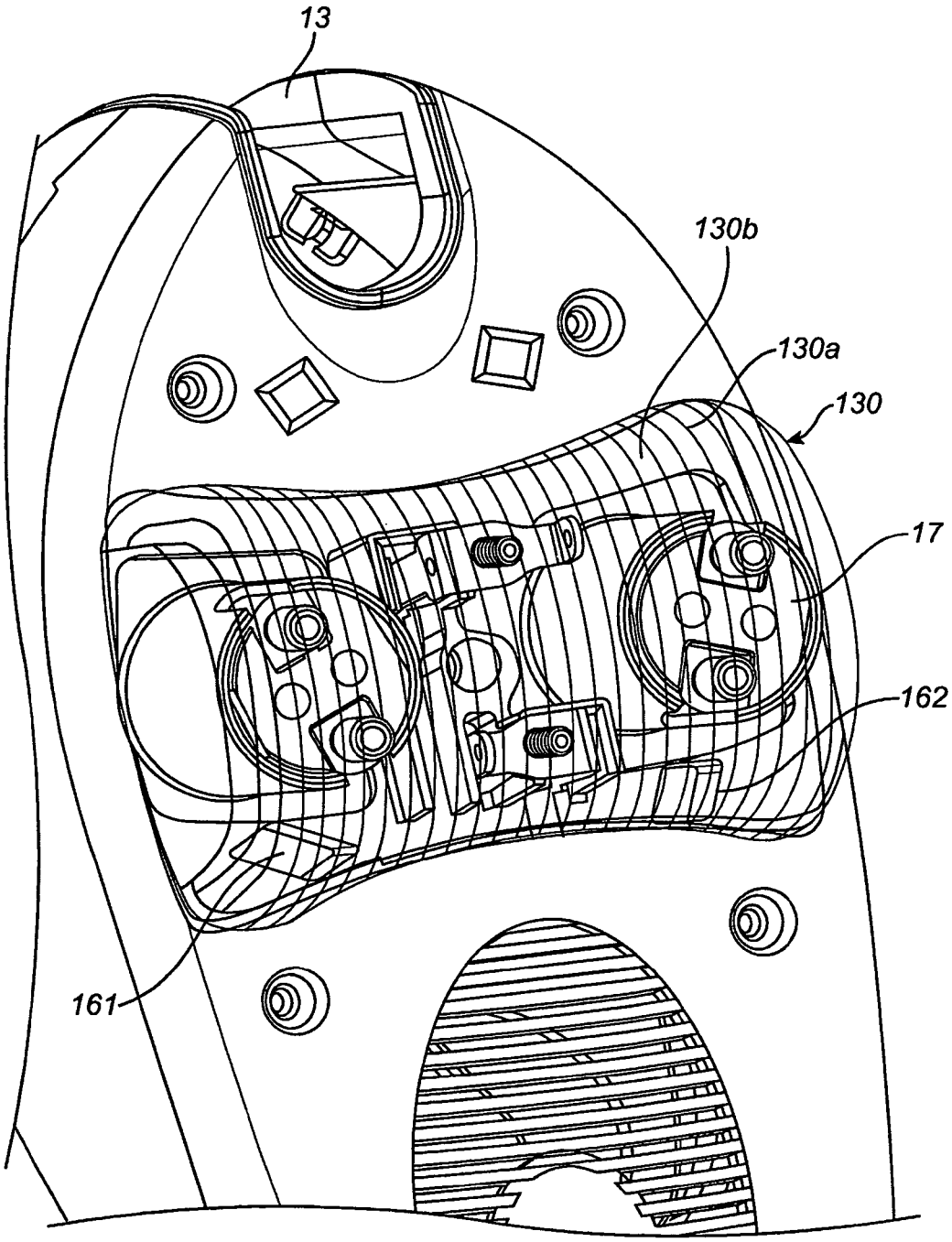
FIG. 19C shows the side cap of the bulbs adjacent the air channels in an installed configuration.

FIG. 19C illustrates side cap 130 in an installed configuration. Side cap 130 substantially encloses the outlets of the channels 161, 162. Side cap 130 may be composed of multiple ribs 130*a* having gaps 130*b* therebetween, which allows cooling air to exit side cap 130.

Figure 20:
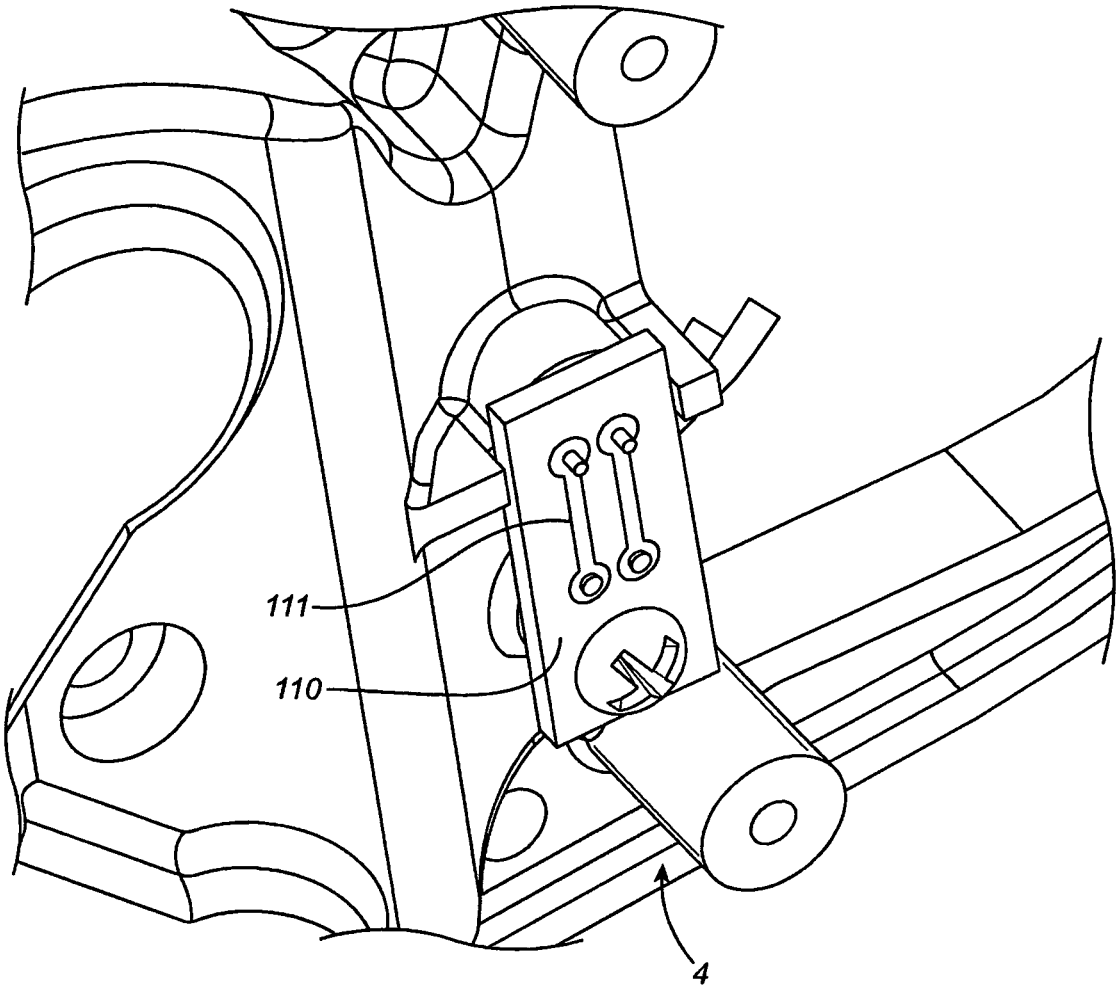
FIG. 20 illustrates a control circuit board for a thermistor used for preventing the tool from overheating.

FIG. 20 illustrates control circuit board 110 for thermistor 111 used in one embodiment for preventing the heating tool 90 from overheating. As illustrated, circuit board 110 may be added to the outside of left reflector housing half 4. Circuit board 110 supports thermistor 111 and the connecting wires. Thermistor 111 provides a temperature feedback to the control circuit in circuit board 110 that temporarily prevents re-triggering of the heat source until the sensed temperature falls below a predetermined threshold.

In accordance with a preferred embodiment of the invention, blower 22 is controlled by circuit board 110 that monitors the temperature via thermistor 111 together with a timer (not shown). The timer may have a preset timing interval, for example, 20 minutes, for controlling the blower 22. The electronic timer is started by depressing trigger 12. The timer is reset every time trigger 12 is depressed, while blower 22 is turned on. If trigger 12 is not depressed within the preset period, and the temperature is below the predetermined threshold, blower 22 is turned off. If trigger 12 is not depressed within the preset period but the temperature is above the predetermined threshold, the blower remains on, then turns off when the temperature drops below the predetermined threshold.

The predetermined temperature threshold may be, for example, about 220° F., which may be adjusted at the factory or by the operator. Control circuit 110 and blower 22 maintain the ambient operating temperature of the external surfaces of heating tool 90, as measured on the high setting and the longest time interval, to be about 130° F. In one embodiment heating tool 90 consumes about 300 watts when triggered, i.e., when the heating elements are turned on and the fan is blowing, and consumes less than 5 watts when plugged in with only the fan operating. In one embodiment of the invention, heating tool 90 is selected to be in an untimed mode. In this embodiment of the invention, as long as trigger 12 is engaged, power is supplied to heating tool 90 without turning power off due to a timer until trigger 12 is released. In the untimed mode, power will shut off when the predetermined temperature threshold is exceeded.

Figure 21A:
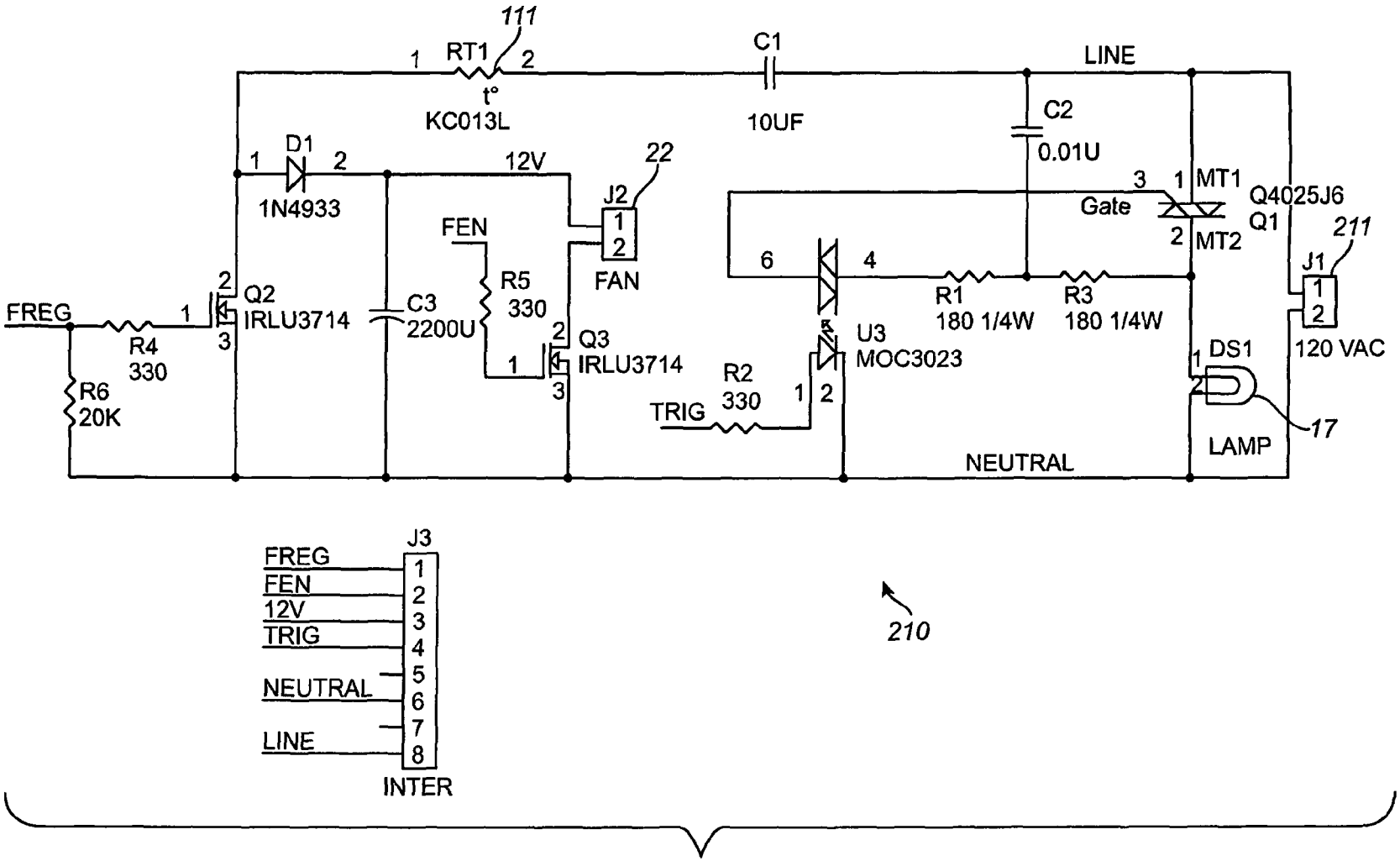
FIG. 21A shows a power circuitry for the handheld heating tool.
Figure 21B:
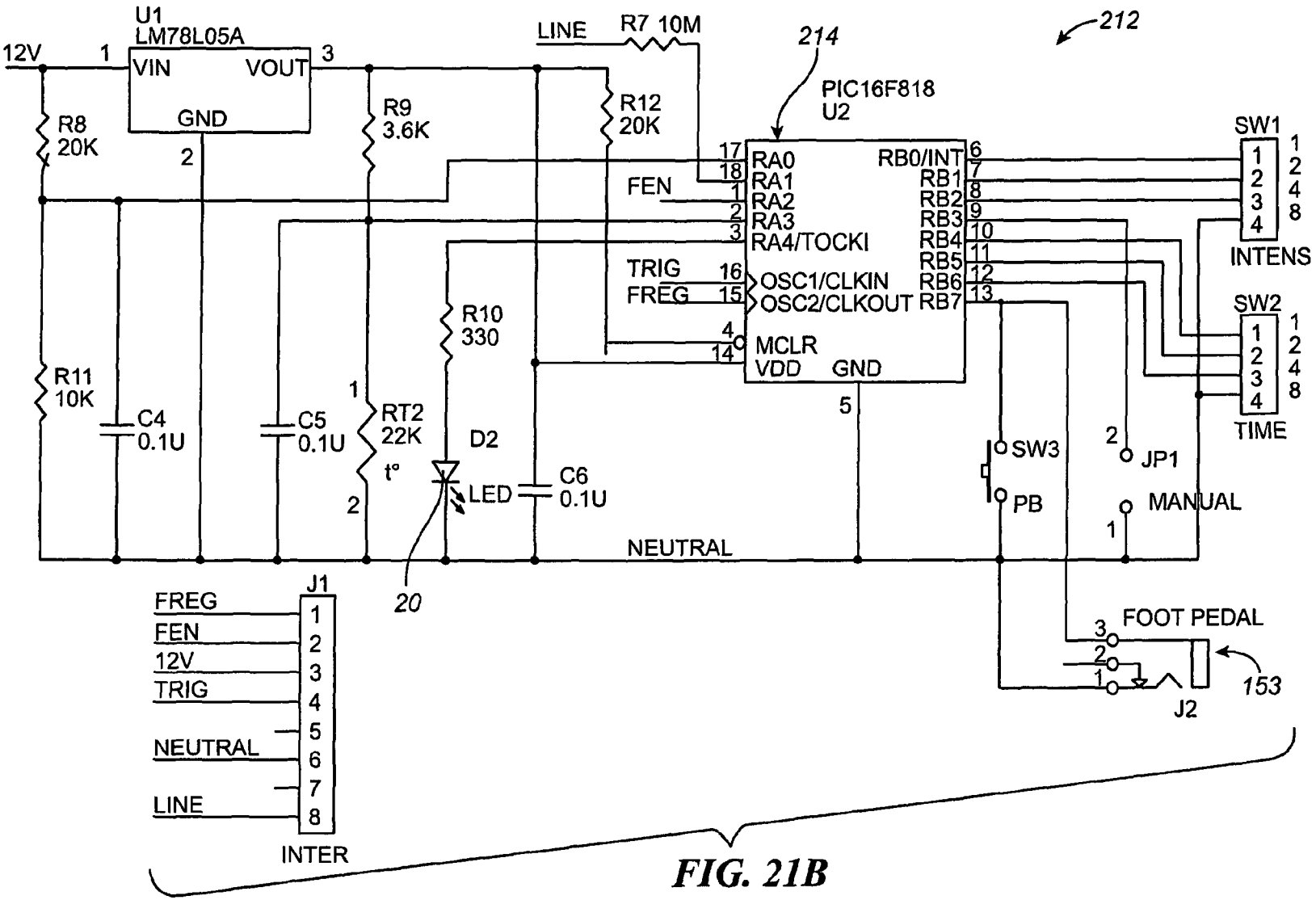
FIG. 21B shows a control circuitry for the handheld heating tool.

FIG. 21A illustrates power circuitry 210 for handheld heating tool 90 in accordance with an embodiment of the invention. As illustrated, power supply 211 provides electricity to both the heating elements 17 and the blower 22. Blower 22 is controlled by thermistor 111 using control circuit 212 as shown in FIG. 21B. As illustrated in FIG. 21B, control circuit 212 includes processor 214, which may run a software program, to control the on/off of heating elements 17 and blower 22 based on temperature feedback from thermistor 111.

FIG. 21B additionally shows foot switch (foot pedal) 153, which can be used instead of trigger 12 when heating tool 90 is operated in the hands-free mode in accordance with one embodiment. In one embodiment, LED 20 is used to indicate whether heating tool 90 is connected to a power source (i.e., plugged into an electrical circuit)

Figure 22A:
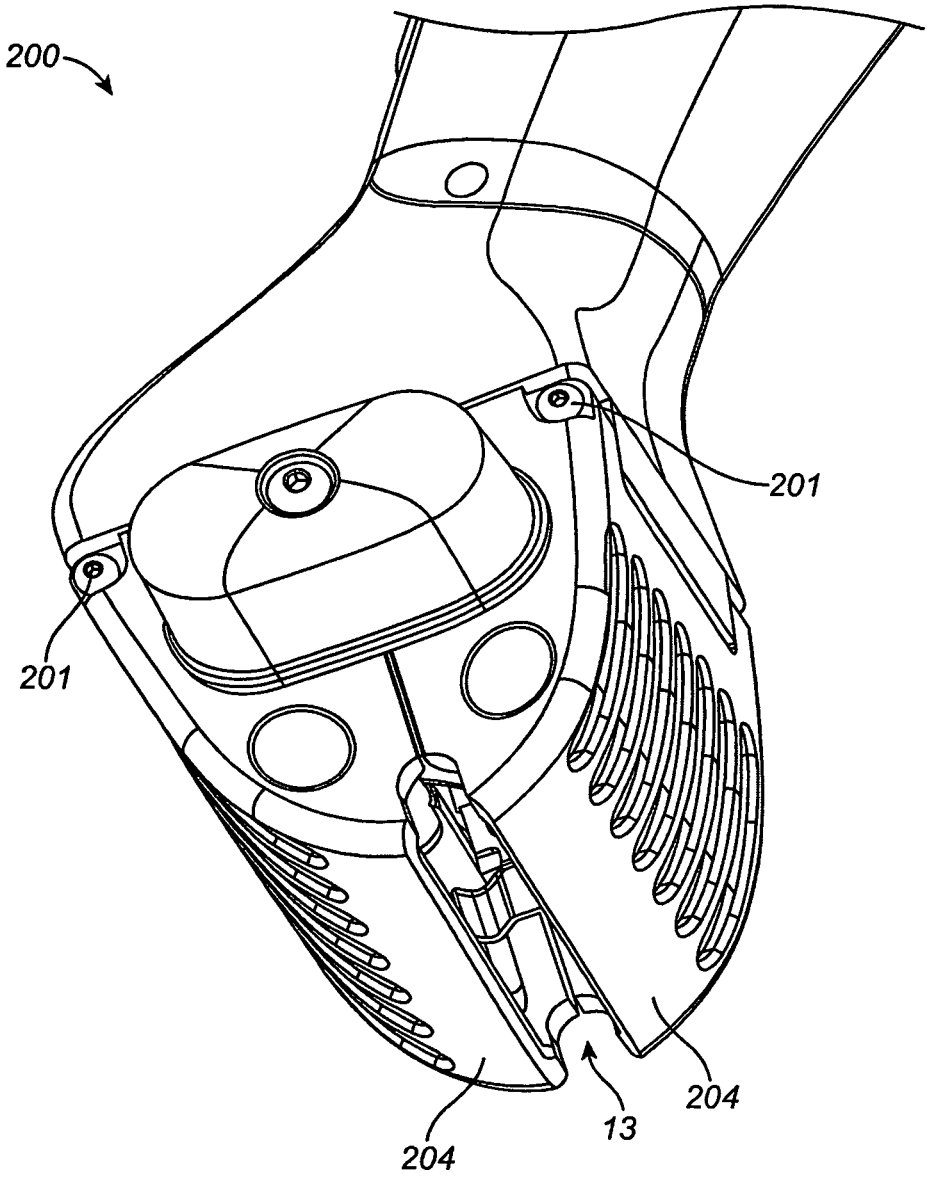
FIG. 22A shows an embodiment of the heating tool having a pair of jaw portions.

FIG. 22A illustrates an embodiment of heating tool 200 having a pair of jaw portions 204. Multiple pivot points 201 are included in the housing of heating tool 200. Through the pivot points 201 the covers/jaws 204 may be opened/closed, or coupled/decoupled from heating tool 200, such that the covers/jaws 204 may be opened in order to clean or inspect the inside surfaces of the housing, or to replace the covers/jaws 204.

Figure 22B:
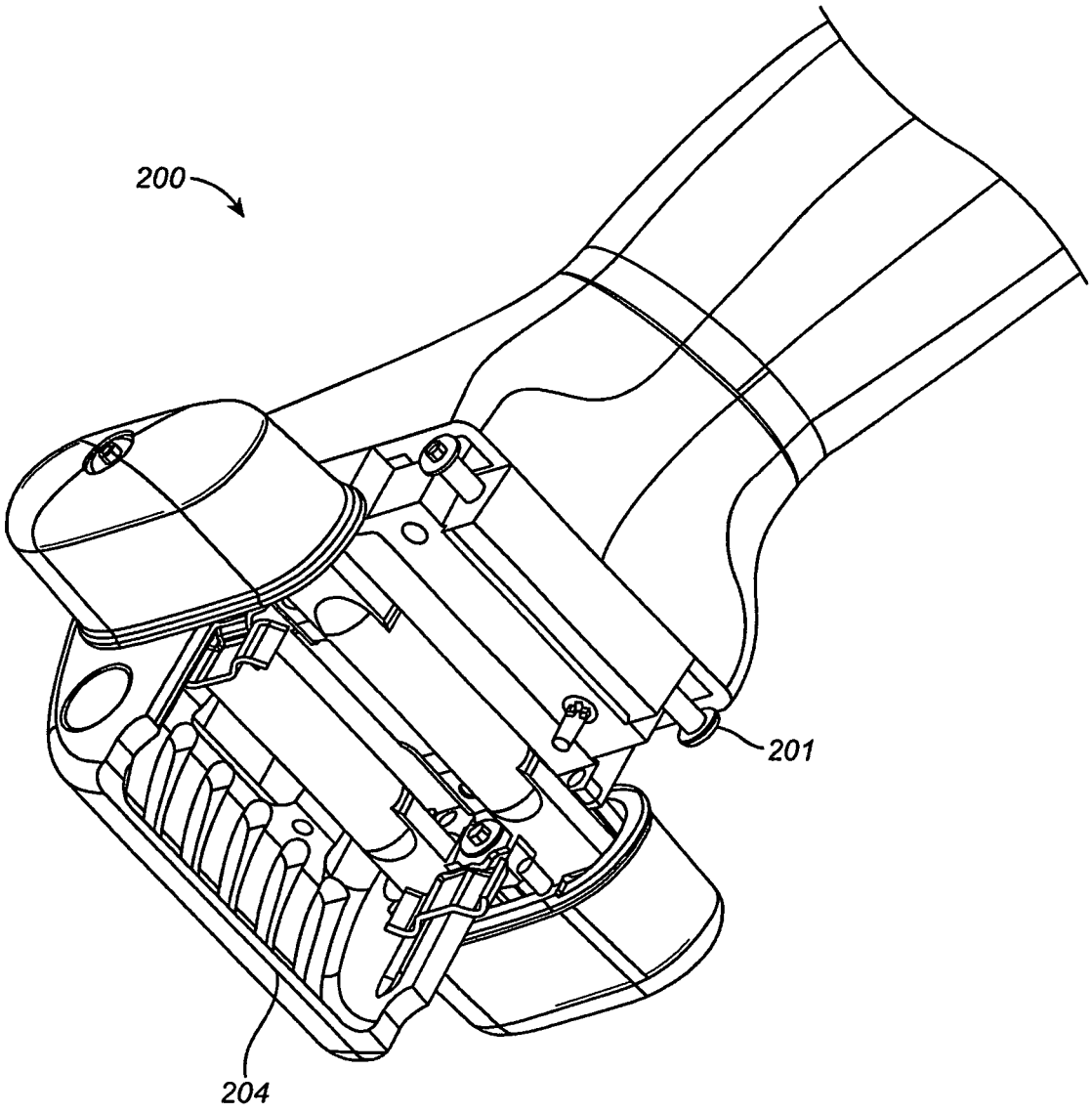
FIG. 22B shows the heating tool of FIG. 22A with one of the jaws removed.

FIG. 22B illustrates heater 200 with one of the jaws 204 removed, and one of the pivot points 201 exposed.

Figure 22C:
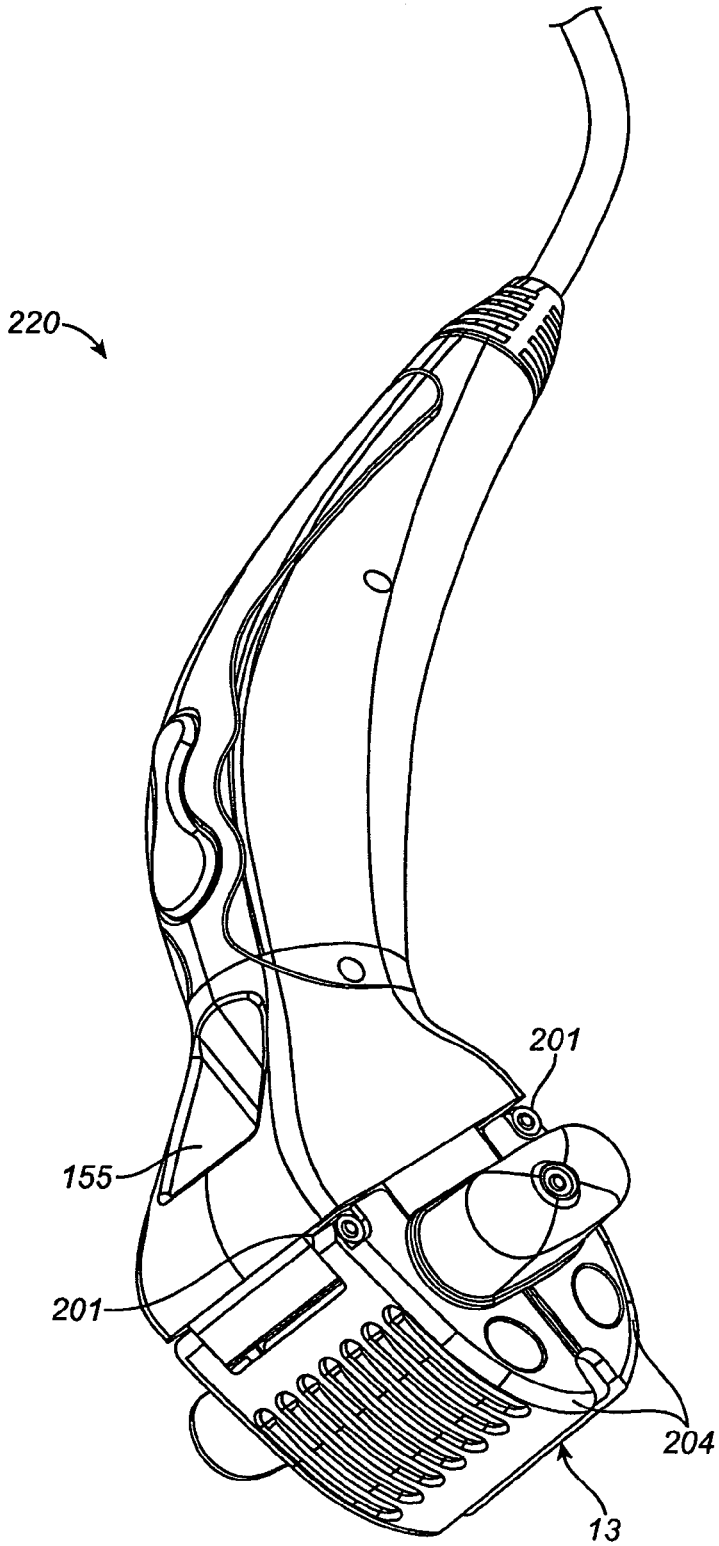
FIG. 22C is a prospective view of a heating tool with a backside window.
Figure 22D:
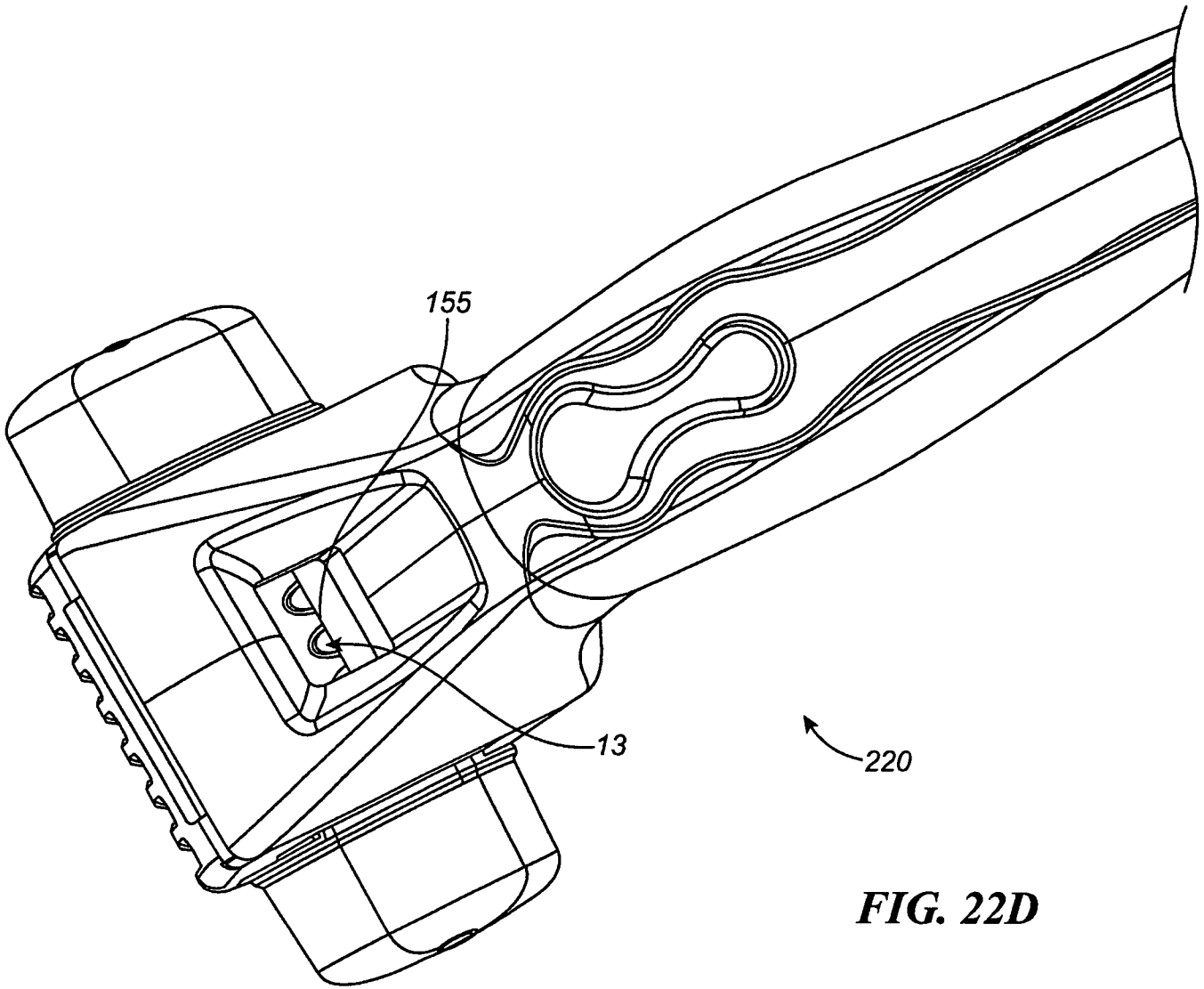
FIG. 22D shows the backside window from a different angle.

FIG. 22C further provides a perspective view of an embodiment of heating tool 220 including jaws 204, pivot points 201, and back window 155, in accordance with an embodiment of the invention. FIG. 22D illustrates backside window 155 of heating tool 220 from a different angle. In this embodiment, window 155 of the housing of heating tool 220 allows the operator to directly view the working area (opening) 13 from the back side.

Figure 23:
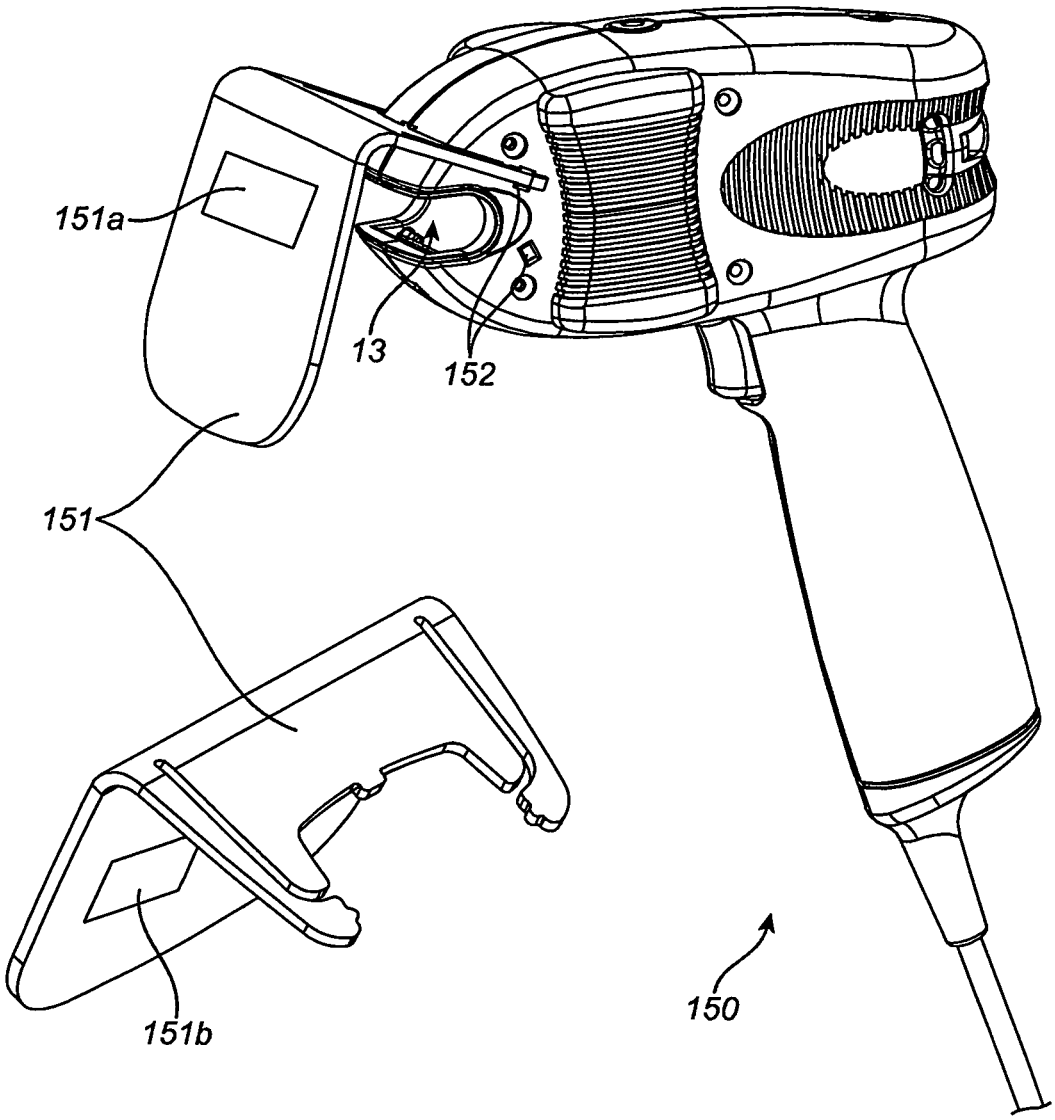
FIG. 23 shows a glare shield for the heating tool.

Referring to FIG. 23, in accordance with some embodiments of the invention, glare shield 151 is included as an accessory of heating tool 150. Glare shield 151 is primarily used in the hands-free mode. Glare shield 151 can also be used in normal operations to reduce the amount of infrared radiation and/or glare emitted from heating tool 150 and to improve the operator's comfort. Two sets of dimples 152 adjacent the nose allow glare shield 151 to snap onto the housing of heating tool 150. As can be seen, glare shield 151 can be snapped on either set of dimples 152, and thus has an adjustable position. Further, glare shield 151 is reversible in its orientation and thus can be used for both the hand-held mode and the hands-free mode.

In accordance with an embodiment of the invention, glare shield 151 is substantially opaque to infrared radiation, but is at least partially transparent for visible light so that the operator may visually examine the progress of heating through glare shield 151. The infrared radiation is substantially filtered by glare shield 151. In accordance with another embodiment of the invention, window 151*a*, which is partially transparent to visible light, in glare shield 151 is used for visual inspection of the working area, i.e., opening 13. In addition, mirror 151*b*, which partially reflects visible light, may be included in the backside of glare shield 151, such that the operator may visually inspect working area 13 from the back side by looking at the reflected image in the mirror 151*b*.

Advantageously, the invention provides a flexible heating tool that can be operated by hands or converted to a hands-free configuration. The heating tool has easily replaceable heat sources and is easy to assemble.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A heating tool, comprising:

a housing having a handle;

at least one heat source;

a control circuit to control power of the at least one heat source;

one or more reflectors enclosed in the housing to focus radiant energy from the at least one heat source toward a focal region;

an opening in the housing for receiving an object to be heated in the focal region; and a blower directing cooling air toward into the housing and exiting the housing, wherein power of the heat source is controlled based on temperature feedback;

wherein the housing includes a window adapted to allow viewing of the opening from the backside of the heating tool.

2. The heating tool of claim 1, wherein the one or more reflectors are formed from a bent sheet of pre-polished metal.

3. The heating tool of claim 1, wherein the one or more reflectors are formed from a mosaic of pre-polished metal panels.

4. The heating tool of claim 1, wherein each of the one or more reflectors has one of the following approximate shapes: elliptical, ellipsoid, or parabolic.

5. The heating tool of claim 1, wherein the at least one heat source comprises at least one of an incandescent bulb, a quartz heat source, a glow bar or a microwave source.

6. The heating tool of claim 1, further comprising a reflector housing to house the one or more reflectors and to provide support to the blower within the housing.

7. The heating tool of claim 1, further comprising:

a connector adapted to attach to a base on a surface to operate the heating tool in a hands-free mode.

8. The heating tool of claim 7, further comprising:

a jack to couple a footswitch in the hands-free operation mode.

9. The heating tool of claim 1, further comprising:

a thermistor providing a temperature feedback to the control circuit to control a temperature from rising above a predetermined threshold level.

10. The heating tool of claim 9, wherein if the housing ambient operating temperature is above a threshold the blower remains powered on, and if the temperature is below the threshold the blower is powered off.

11. The heating tool of claim 1, further comprising:

a reflector housing, wherein each of the one or more reflectors includes a protrusion, and the reflector housing includes a receptor for receiving the protrusion.

12. The heating tool of claim 1, wherein the housing further comprises a removable side cap configured to support a socket for the at least one heat source, and the side cap comprises at least one contact terminal for receiving at least one corresponding contact terminal of the at least one heat source.

13. The heating tool of claim 1, further comprising:

a glare shield removably coupled to the housing of the heating tool.

14. The heating tool of claim 13, wherein the housing comprises a plurality of dimples adjacent an opening for the glare shield to snap onto the housing.

15. The heating tool of claim 13, wherein the glare shield comprises at least one of a mirror and a portion that is at least partially transparent to visible light.

16. The heating tool of claim 1, further comprising:

a nose portion enclosing at least a portion of the opening, wherein the nose portion is removably coupled to the housing.

17. The heating tool of claim 1, further comprising:

a plurality of pivot points on the housing, wherein at least a portion of the housing is openable about the pivot points.

18. The heating tool of claim 1, further comprising:

a reflector housing, wherein the reflector housing comprises:

a plurality of parallel air channels; and a plurality of airflow adjusting members configured to direct air through the parallel air channels.

19. The heating tool of claim 1, wherein at least a portion of the control circuit is included on a first circuit board disposed within the handle, and at least a portion of the control circuit is included on a second circuit board adjacent a controller for the heating tool, the circuit board being configured to provide a support for the controller.

20. The heating tool of claim 1, wherein the blower maintains an ambient operating temperature of external surfaces of the housing.

21. The heating tool of claim 1, wherein a timer controls operation of the blower.

22. The heating tool of claim 21, wherein a trigger coupled to the handle resets the timer.

23. The heating tool of claim 1, further comprising:

a thermistor providing the temperature feedback to the control circuit to control power to the heat source.

24. A method for operating a heating tool, comprising:

positioning the heating tool;

placing an object to be heated through an opening of the heating tool;

controlling power and/or time duration of a heat source to heat the object;

controlling power of a blower for cooling external surfaces of a housing of the heating tool, wherein the opening of the heating tool is located at a focal region of energy focused by one or more reflectors;

wherein the heating tool includes a window adapted to allow viewing of the opening from the backside of the heating tool.

25. The method of claim 24, further comprising:

covering the opening of the heating tool with a glare shield.

26. The method of claim 25, further comprising:

inspecting progress of heating the object through at least one of a portion of the glare shield that is at least partially transparent for visible light, a mirror, and a window on the backside of the heating tool.

27. The method of claim 24, further comprising:

using a footswitch when the heating tool is operated in a hands-free mode to control power and time duration of the heat source.

28. A handheld heating tool, comprising:

at least one heat source that generates radiant energy;

one or more reflectors that focus the radiant energy toward a focal region, wherein the focal region about an object to be heated is adjustable;

one or more passages that pass air around the at least one heat source to provide cooling;

a control circuit that prevents overheating by controlling power to a heat source based on a temperature threshold; and a connector that fixes the tool to a surface;

wherein the housing includes a window adapted to allow viewing of the opening from the backside of the heating tool.

29. The handheld heating tool of claim 28, further comprising:

a glare shield that reduces glare from the at least one heat source that generates radiant energy.

* * * * *